US009352180B2

(12) United States Patent
Pawlas

(10) Patent No.: US 9,352,180 B2
(45) Date of Patent: May 31, 2016

(54) VARIABLE WEIGHT MEDICINE BALL

(71) Applicant: GProducts LLC, Louisville, CO (US)

(72) Inventor: Gary E. Pawlas, Louisville, CO (US)

(73) Assignee: GPRODUCTS, LLC, Louisville, CO (US)

( * ) Notice: Subject to any disclaimer, the term of this patent is extended or adjusted under 35 U.S.C. 154(b) by 0 days.

(21) Appl. No.: 14/887,586

(22) Filed: Oct. 20, 2015

(65) Prior Publication Data

US 2016/0107017 A1 Apr. 21, 2016

Related U.S. Application Data

(60) Provisional application No. 62/066,314, filed on Oct. 20, 2014.

(51) Int. Cl.
*A63B 21/06* (2006.01)
*A63B 21/00* (2006.01)

(52) U.S. Cl.
CPC ..... *A63B 21/00065* (2013.01); *A63B 21/0004* (2013.01); *A63B 21/06* (2013.01)

(58) Field of Classification Search
CPC .. A63B 15/00; A63B 15/005; A63B 21/0004; A63B 21/0061; A63B 21/00065; A63B 21/0604; A63B 21/0608; A63B 21/062; A63B 21/0626; A63B 21/0628; A63B 21/063; A63B 21/072; A63B 21/0722; A63B 21/075; A63B 37/10
See application file for complete search history.

(56) References Cited

U.S. PATENT DOCUMENTS 777,478 A 12/1904 Minor
1,316,683 A * 9/1919 Calvert ..... A63B 21/072 473/125
6,387,022 B1 5/2002 Smith
7,381,157 B2 * 6/2008 Blateri ..... A63B 21/075 482/106
7,491,157 B1 * 2/2009 Lin ..... A63B 21/0728 482/107
8,454,483 B1 6/2013 Bradley et al.
8,568,280 B2 * 10/2013 Mendoza ..... A63B 21/072 482/108
2013/0059701 A1 * 3/2013 Santa Cruz ..... A63B 21/0606 482/108

OTHER PUBLICATIONS

Dynamax, Inc., "Medicine Ball", "Webpage found at http://www.medicineballs.com/ downloaded on Jul. 27, 2015", , p. 2, Published in: US.
Rage, "Rage 14 Inch Medicine Ball", "Webpage found at http://www.ragefitness.com/rage-14-inch-medicine-ball-cf-mb004 downloaded on Jul. 27, 2015", , p. 6 Published in: US.
Tachikara, "SV5WS Sensi-Tec Composite Volleyball", , p. 1 Published in: US.
Ugi Fitness, "The Ugi Ball", "Webpage found at http://www.ugifit.com/en/what-ugi/ugi-ball downloaded on Jul. 27, 2015", , p. 2 Published in: US.

* cited by examiner

*Primary Examiner* — Oren Ginsberg
(74) *Attorney, Agent, or Firm* — Neugeboren O'Dowd PC

(57) ABSTRACT

Apparatuses and systems for a variable weight medicine ball are disclosed. The ball may comprise an outer shell, an interior, and a radius, and an opening forming a portion of the outer shell that provides access to the interior. The ball may also comprise at least one exercise weight cavity in the interior configured to receive one or more exercise weights and a filling material disposed in the interior, between the plurality of weight cavities and the outer shell. The ball may further comprise one or more balance weights that are different from the exercise weights fixedly disposed within the filling material.

28 Claims, 12 Drawing Sheets

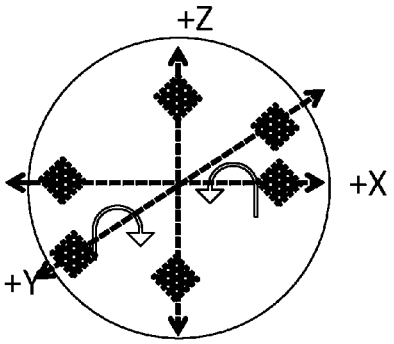
FIG. 10A
Oblique view of sphere and weights
View of FIG. 10 B obtained by:
Rotating the sphere about the Coord Axes as follows:
1. Rotate +45° aboutYaxis,
2. Rotate -45° about X Axis
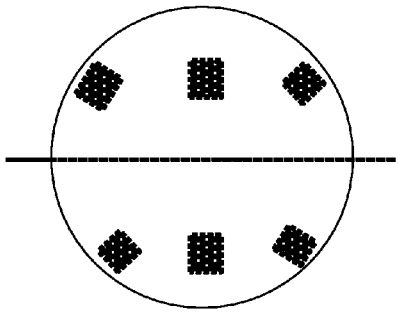
FIG. 10B
Side view of sphere and weights
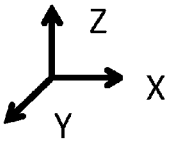

FIG. 11A
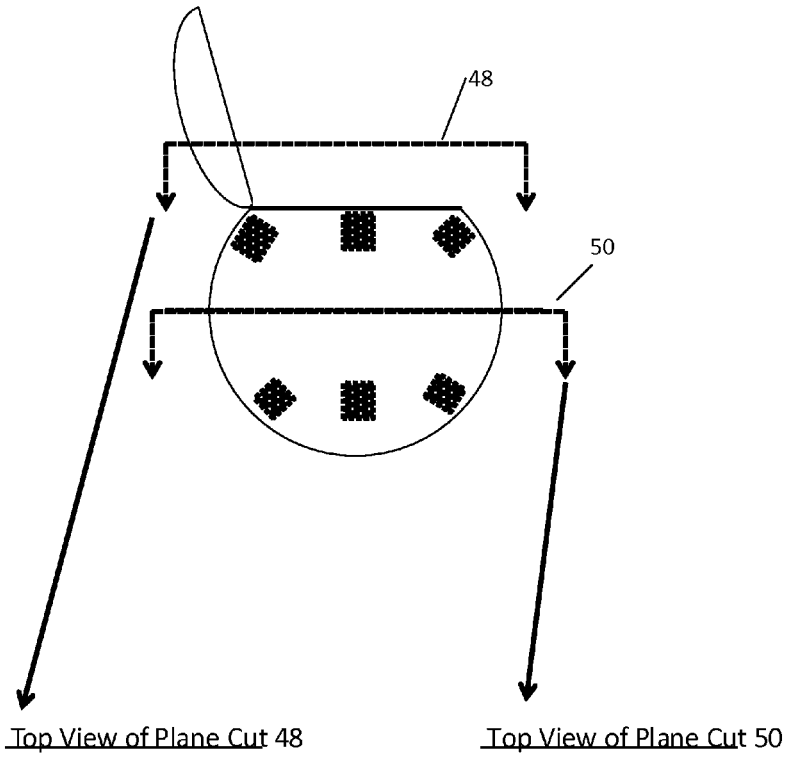
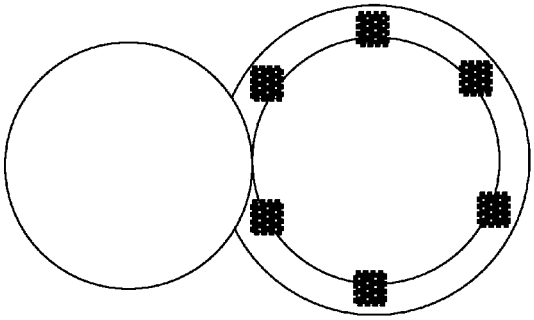
FIG. 11B
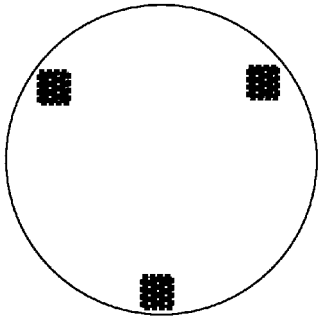
FIG. 11C

VARIABLE WEIGHT MEDICINE BALL

CLAIM OF PRIORITY UNDER 35 U.S.C. §119

The present Application for Patent claims priority to Provisional Application No. 62/066,314 entitled "VARIABLE WEIGHT MEDICINE BALL" filed Oct. 20, 2014, and assigned to the assignee hereof and hereby expressly incorporated by reference herein.

FIELD OF THE DISCLOSURE

The present disclosure relates to apparatuses, systems, and methods for exercise equipment of variable weight. Specifically, but without limitation, the present disclosure relates to variable weight medicine balls.

BACKGROUND

Medicine balls have existed for literally thousands of years, with the earliest documented use by Persian wrestlers who trained with animal bladders or skins filled with sand. They are primarily used to create explosive power in athletes (e.g., by developing muscles necessary to propel a medicine ball vertically upward as fast as possible) as well as to increase strength in the core of the body (e.g., by performing sit-ups with a medicine ball).

To progressively create more explosive power or increase core strength, an athlete needs medicine balls of different weights. But purchasing multiple medicine balls is expensive and takes up storage space. Therefore, a need exists for a medicine ball to which weight can be added, in order to reduce cost and the need for multiple pieces of equipment.

Currently, some medicine balls to which weight may be added do exist. However, in these currently existing medicine balls, when additional "exercise" weights are added the ball may be "unbalanced" meaning that the center of mass (or center of gravity) of the ball is not at the geometric center of the ball. A medicine ball patent over one hundred years old (U.S. Pat. No. 777,478 to Minor) discloses the addition of weights. However, the weights are added at the periphery of the medicine ball in one of two cavities in such a way as to cause the center of mass to not be located at the center of the ball. Offsetting the center of mass causes the ball to wobble as it rotates thus making it difficult to hold, throw, and/or catch. Other patents, including U.S. Pat. No. 8,454,483 to Bradley et al., and U.S. Pat. No. 6,387,022 to Smith also disclose variations on the adjustable weight medicine ball. But these patents also neglect to take into consideration the effect of weight addition on the center of mass.

The unbalance causes the ball to wobble when it is thrown through the air, making it difficult to throw and/or catch, thus increasing the chance of injury to the person catching the ball. The unbalance can also make the ball difficult to hold onto when it is moved during strengthening exercises. Earlier inventions did not address the issue of balancing the ball in all coordinate directions when additional weights are added. Therefore, a need exists for a variable weight medicine ball that remains balanced and creates a minimum amount of wobble when different weights are added.

SUMMARY

One aspect of the present disclosure provides a medicine ball, which may comprise an outer shell, an interior, and a radius, and an opening forming a portion of the outer shell that provides access to the interior. The ball may also comprise at least one exercise weight cavity in the interior configured to receive one or more exercise weights and a filling material disposed in the interior, between the plurality of weight cavities and the outer shell. The ball may further comprise one or more balance weights that are different from the exercise weights fixedly disposed within the filling material.

Another aspect of the disclosure provides a system for varying the weight of a medicine ball with a minimum of weight unbalance. The system may comprise a ball having an outer shell, an interior, and a radius, and the ball itself may comprise an opening forming a portion of the outer shell that provides access to the interior, and at least one exercise weight cavity in the interior configured to receive one or more exercise weights. The ball may further comprise a filling material disposed in the interior, between the plurality of weight cavities and the outer shell and one or more balance weights. The system may further include a plurality of exercise weights configured to fit within the at least one exercise weight cavity.

Yet another aspect provides a medicine ball having an outer shell, an interior, a radius, and circumference which may comprise at least one exercise weight cavity in the interior configured to receive one or more exercise weights and a filling material disposed in the interior, between the plurality of weight cavities and the outer shell. The ball may also comprise one or more balance weights that are different from the exercise weights fixedly disposed within the filling material. The ball may be is separable into two substantially equal hemispheres by opening a closure along the circumference of the ball, and a portion of the at least one exercise weight cavity may be located in each of the hemispheres.

BRIEF DESCRIPTION OF THE DRAWINGS

Some embodiments are now described, by way of example only, and with reference to the accompanying drawings. The same reference number represents the same element or the same type of element on all drawings.

FIGS. 10A and 10B illustrate the location and orientation of balance weights within a medicine ball according to embodiments of the present disclosure.

FIGS. 11A, 11B and 11C illustrate top cross-sectional views of an embodiment of a medicine ball with a lid opening, and show the location of several balance weights.

DETAILED DESCRIPTION

Figure 1:
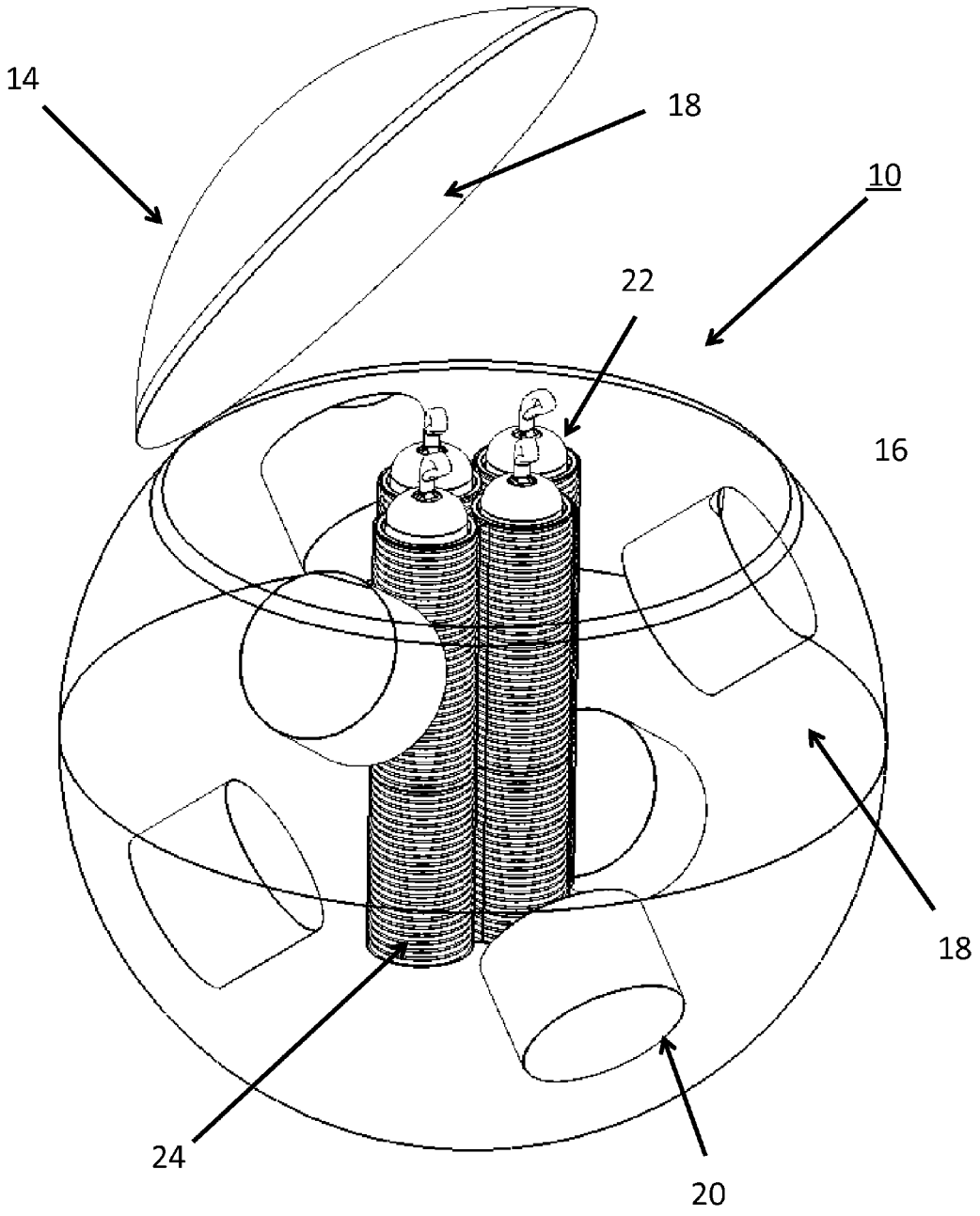
FIG. 1 shows a perspective view of a medicine ball in an assembled state in accordance with an embodiment of the present disclosure.

FIG. 1 shows a perspective view of a medicine ball 10 in accordance with the present disclosure in an assembled state. The variable weight medicine ball 10 has an outer shell main body 12, which contains various components, and a shell lid 14, which contains filling material 18. The shell lid 14 is shown open in this view. The shell main body 12 and lid 14 can be made from a variety of substances capable of withstanding high stresses, abrasion, and exposure to sun, and may include fabrics, rubbers, plastics, leather, synthetic leather, or other suitable materials. In one embodiment, both pieces of the shell are made of pieces of heavy weight fabric such as 18 oz. vinyl coated polyester, and are sewn together into the desired shape. In this embodiment, the shell fabric pattern comprises several panels of material, and when they are joined (e.g., via sewing or adhesive) together, the shape approximates a sphere as occurs in a soccer ball, volleyball, baseball, and other substantially spherical balls used for sports. Though embodiments discussed herein include the use of certain types of fabric or foam, which may create a medicine ball with a substantially pliable, or even soft outer surface, this disclosure also pertains to medicine balls with substantially rigid or hard outer surfaces, such as those made from rubber.

In addition, the shell lid 14 and the shell main body 12 may be joined by a flexible closure 16 to create an opening through which exercise weights 22 can be inserted or removed. The flexible closure 16 may be made of hook and loop material, buckles, or any other closure system that allows the two portions of the shell to be closed together or opened for the insertion of the exercise weights 22. In some embodiments, the flexible closure may be a plastic coil zipper with the coil turned to the interior of the ball 10, which may protect the coils from damage. By orienting the coil toward the interior, the smooth zipper tape side of the zipper faces outwards, which provides the advantage of minimizing friction and wear when it comes in contact with a user's hand or other surfaces, such as floors or walls. If a hook and loop material is used, it may be desirable to use hook and loop material capable of more than 10,000 open/close cycles.

The shell main body 12 and the shell lid 14 (which may also be referred to simply as the "main body 12" and the "lid 14" can create an opening of any desired shape. For example, the opening could split the shell into two equal hemispheres creating a circular opening with a radius equal to the ball radius. Embodiments of medicine balls comprising two substantially equal hemispheres will be depicted later in this disclosure. In those embodiments, one of the hemispheres may be referred to as a lid. Alternatively, the opening could have a rectangular or some other type of shape. In any case, the opening may be large enough to insert or remove exercise weights as well as insert other interior components of the ball. These other interior components may include balance weights 20, filling material 18, and receptacles for exercise weights 24, and may be inserted during the manufacturing of the ball. In some embodiments, the opening is created by a plane cut in the upper hemisphere of the ball resulting in a circular opening with a radius smaller than the radius of the ball, as shown in FIG. 1. This creates a lid 14 on the ball with a circular opening of sufficient size to allow for insertion of the interior components of the ball during manufacturing of the ball. Additionally, the lid 14 as shown and described also allows easy access for the user to remove and insert exercise weights during use of the ball. This circular opening shape may be advantageous because it eliminates stress concentrations in the outer shell when the sphere has forces exerted on it (i.e., when the ball is thrown and then is caught or falls to the ground). Non-circular openings can contain stress concentrations (e.g., in corners) that can lead to an unexpected opening of the flexible closure, failure of the shell material, excess wear, or other problems.

The shell lid 14 need not remain attached to the shell main body 12 when the flexible closure 16 is opened. For example the lid 14 could be removed entirely from the shell main body 12, or it could remain attached by a tether. In the embodiment shown, the lid 14 created by the opening remains attached to the main body of the shell 12, which provides a number of advantages, including proper alignment of the shell lid 14 to the shell body 12 when closing the lid 14, as well as to ensure the lid 14 is not lost. In another embodiment, if the opening was rectangular in shape, one side of the rectangular opening would remain attached to the ball while the other three sides were released from the flexible closure, as occurs on a suitcase. In the embodiment shown in FIG. 1, the shell lid 14 and shell main body 12 are joined to the flexible closure 16 along a desired portion of the flexible closure 16 to create an opening of desired length around the flexible closure 16.

Two dimensions of any given medicine ball according to the present disclosure are the size (i.e. diameter) and a minimum "base" or "empty" weight. In this disclosure, the terms "weight" and "mass" will be used interchangeably since they are proportional assuming a constant gravitational attraction. Different exercisers may desire different diameter balls or different base weights. An aspect of the present disclosure provides a way to set the base or "empty" weight of a ball of desired radius through two methods. The first method to set the base empty weight of the ball is determined by the weight of several components including the weight of the shell main body 12 and shell lid 14 and flexible closure 16, filling material 18, exercise weight receptacle 24 (if used) and balance weights 20. In some embodiments, the components may also include a balance weight supporting structure, which will be described later in the disclosure. The second method to set the base or "empty" weight of the medicine ball in this embodiment is to include a number of balance weights 20 of a desired mass.

An aspect of the disclosure also provides ways to prevent the ball from wobbling or being "unbalanced" after adding additional exercise weights 22. Though the word unbalance is commonly used as a verb meaning "to cause something to lose balance," it is used as an adjective herein to describe the state of an object being wobbly due to various physical forces. Additionally, measurements of unbalance are defined specifically throughout this disclosure and used as nouns in order to describe how an unbalanced (adjective) ball behaves in response to physical forces. Keeping the ball balanced regardless of how many exercise weights are added may help a user to avoid injury. Embodiments of the medicine ball use the filling material 18 density and mass, and the number and position of the balance weights 20 to ensure that any unbalance or wobble of the ball is below a desired amount when exercise weights 22 are added to the medicine ball.

Several types of filling material may be used in the interior of a medicine ball in accordance with the present disclosure. The filling material may be chosen based on the density of the material as well as its firmness. The density of the filling material is important because it contributes to the base weight of the medicine ball. The weight of the filling material is a found by multiplying the density of the material (in lb./ft$^3$) times the volume of the filling material (ft$^3$). The firmness of the filler is important because it determines how hard or soft the ball feels to the user.

One aspect of the present disclosure is that the balance weights may be held in a fixed position throughout the product life. This may be accomplished in part by using the filling material itself to provide some structural support and positioning of the balance weights and exercise weights over time while the ball is being used. In some embodiments, the density of the filling material itself may provide all the necessary structural support to keep the balance weights in position. For example, a hard foam with holes cut out for the balance weights may be sturdy enough to hold the balance weights in place.

Figure 2:
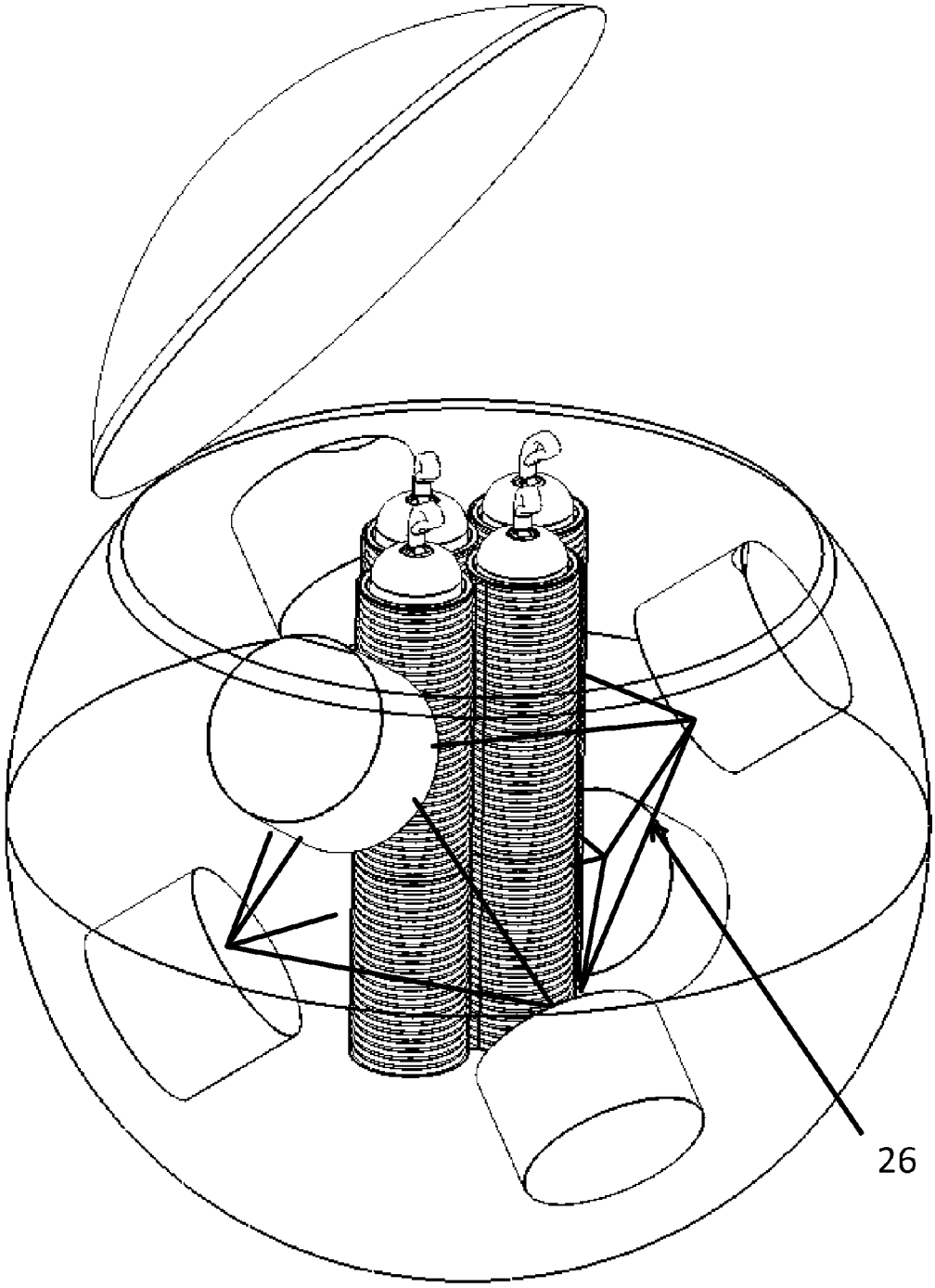
FIG. 2 illustrates the use of a positioning and support structure for the balance weights.

In other embodiments, however, the filling material could comprise loose particles (e.g., foam, sand, fibers made of various materials such as plastic) that are placed inside the ball and packed around the balance weights when they are in the proper position. FIG. 2 shows an embodiment of how a balance weight positioning structure 26 could be created out of suitable materials (e.g. fabric, plastic, foam, etc.) to position and hold the balance weights in the proper location and then have the filling material placed around the structure and balance weights. Other embodiments for holding and/or positioning the balance weights in place are contemplated. For example, balance weight cavities may be attached to the shell main body 12 before placing filling material around the cavities. Other methods are disclosed below for embodiments in which the filling material is a finite number of pieces (e.g., one or two pieces) of material.

Figure 3:
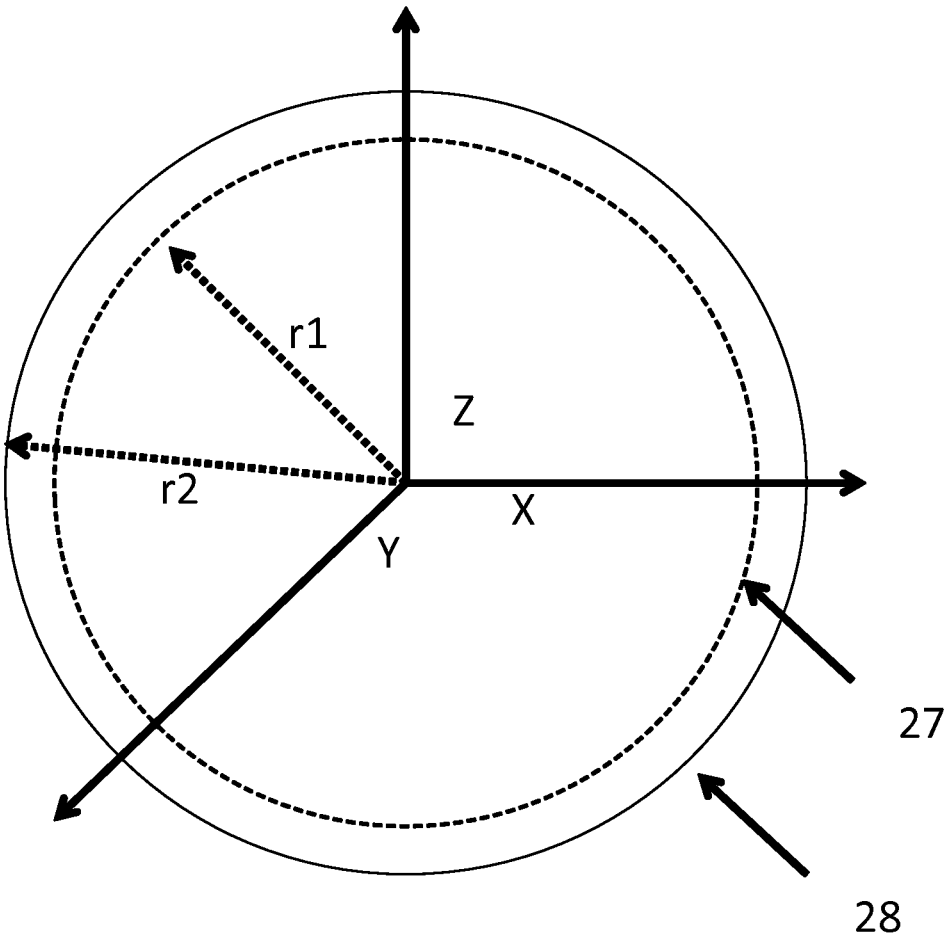
FIG. 3 illustrates an embodiment of a medicine ball showing an spherical outer shell of a radius r2 and a spherical inner balance weight shell of an inner radius r1, and depicting three coordinate axes used as references to describe positions of various components of the disclosure.

FIG. 3 illustrates a spherical shell 28 of outer radius r2 and inner radius r1 having a mass determined by the choice of material, various embodiments of which will be described later in the disclosure. Additionally, FIG. 3 shows an embodiment where a balance weight or weights may be located in a thin shell layer 27 at a constant radius near the periphery of the ball 28. Various embodiments of balance weights will also be described in further detail throughout the disclosure.

Figure 4:
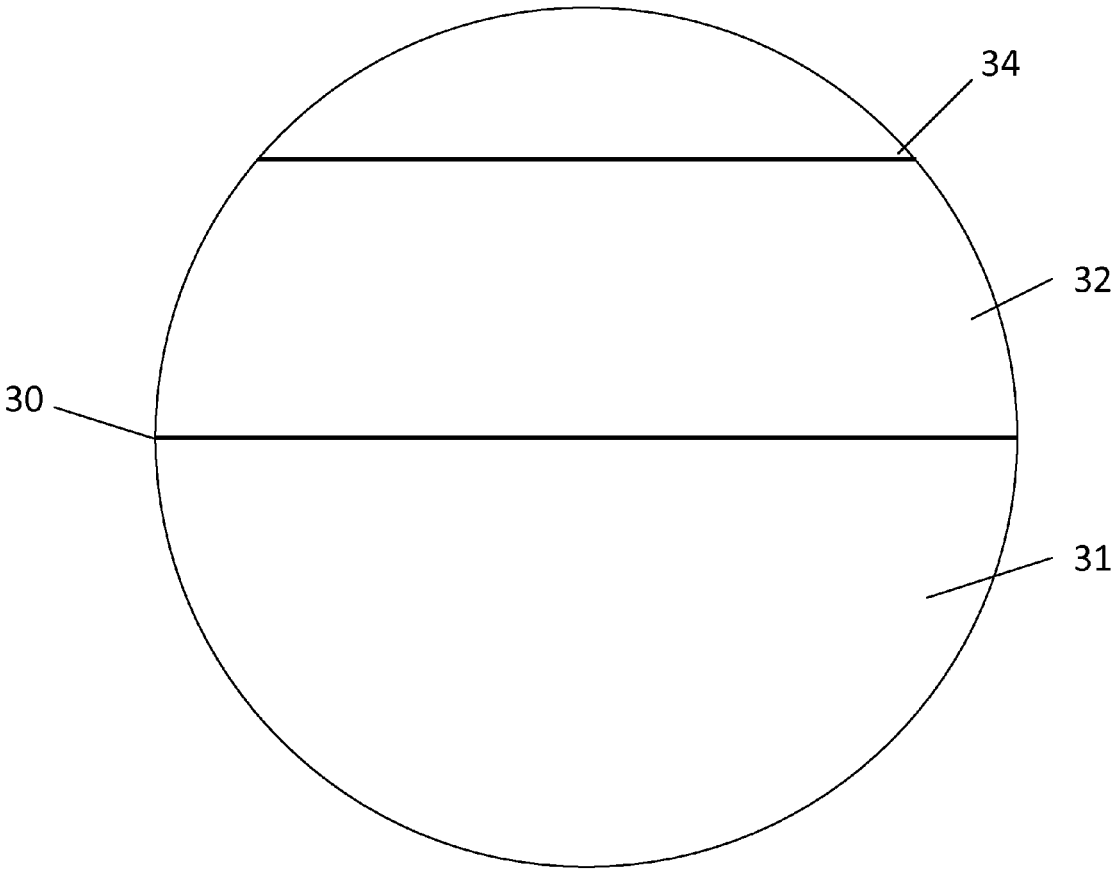
FIG. 4 shows a side view a medicine ball with two exemplary locations of an opening to the interior, one location being in the middle and creating two hemispheres and another location being disposed toward one end of the ball and creating a lid.
Figure 5:
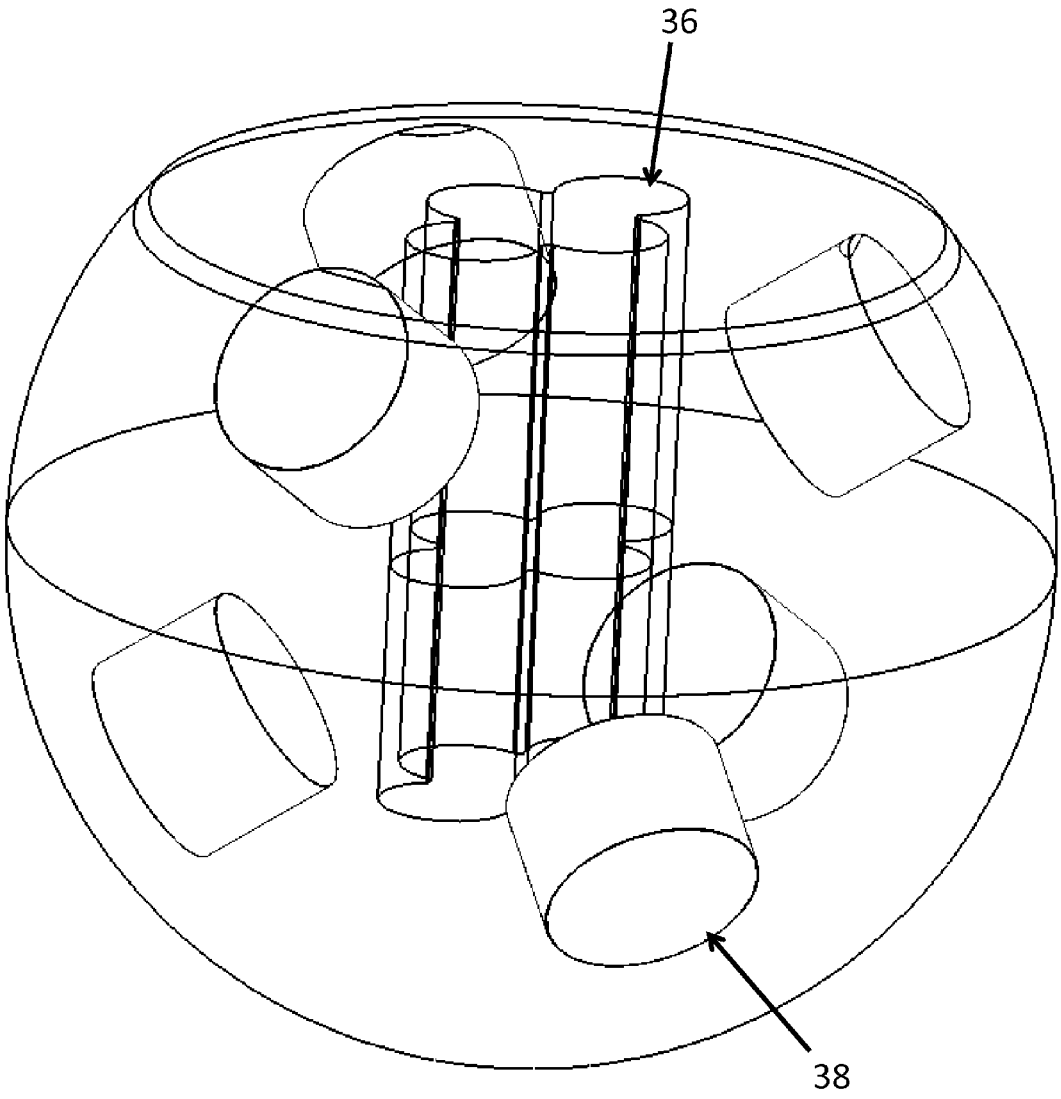
FIG. 5 shows a schematic view of the exercise weight and balance weight cavities formed within the filling material according to an embodiment of the present disclosure.

In various embodiments, a single sphere of polyurethane foam or two hemispheres of polyurethane foam may be created in the desired diameter to comprise the filling material 18. FIG. 4 shows a side view of two hemispheres of a chosen diameter with one of the hemispheres having a lid formed by a plane cut through the upper hemisphere. In the present embodiment, cavities are created in the foam as shown in FIG. 5 to accommodate a fixed number of balance weights as well as a cavity for the exercise weight receptacle and/or exercise weights. Cavities are created in the foam using means typical to those skilled in the art of working with foam such as knives, rotary tools, etc. The cavities are located/positioned in desired locations disclosed later in this specification to hold/maintain the balance weights in the desired locations. One type of foam that may be used is polyurethane foam of density 2.0 lb/ft^3 or greater. This density ensures a long life of the foam as well as provides sufficient weight to help minimize the unbalance or wobble of the ball. The firmness (ILD=Indentation Load Deflection or IFD=Indentation Force Deflection) of the polyurethane foam used is independent of the density of the foam and is selected based on the exerciser user's preference. In one embodiment, a plane cut may be made in the top of the foam sphere or the top hemisphere of foam, above the balance weights, along the plane 34 and this piece of foam may become part of the shell lid 14. In another embodiment, a sphere may be cut into two equal hemispheres at the plane 30, such that a top hemisphere 32 and a bottom hemisphere 31 are created. As will be described throughout this disclosure, the two hemispheres 31 and 32 may provide access to the interior of the ball, which may contain exercise weight cavities, balance weight cavities, and other components. In many embodiments comprising two hemispheres, the hemispheres may be attached to each other by a flexible closure (such as a zipper or hook-and-loop) that encircles the circumference of the ball, either in whole or in part.

Figure 6A:
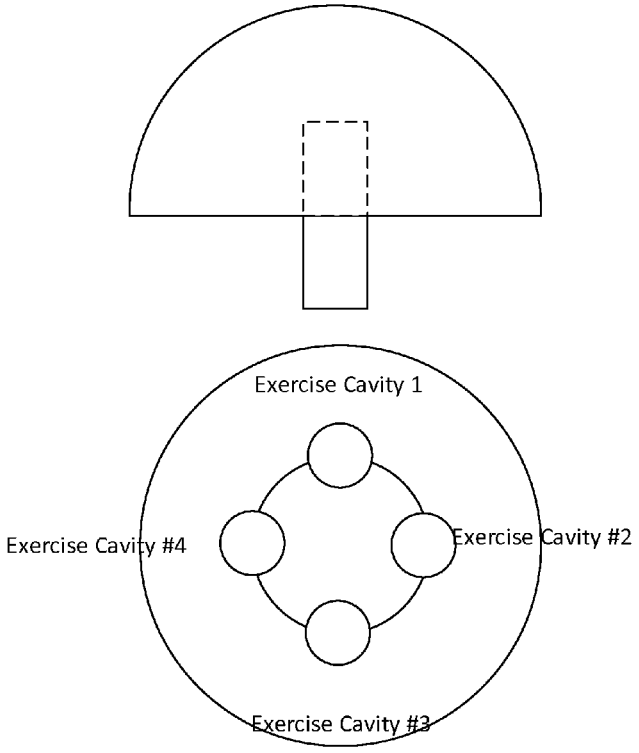
FIG. 6A illustrates a side view of an upper hemisphere of a medicine ball and a top view of a lower hemisphere in one embodiment wherein four separate exercise cavities accommodate additional exercise weights at a desired radius from the center of a sphere.
Figure 7A:
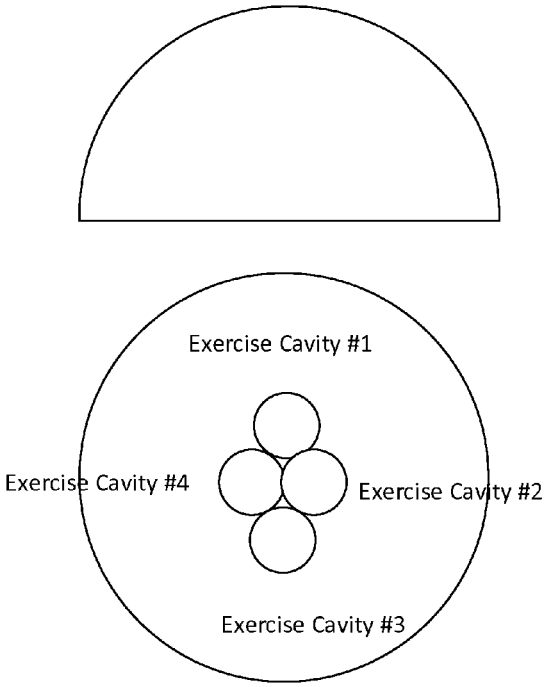
FIG. 7A illustrates a side view of an upper hemisphere of a medicine ball and a top view of a lower hemisphere of another embodiment wherein a single cavity accommodates multiple exercise weights arranged about the center of the sphere.

In some embodiments, a cavity or cavities for the exercise weights may be created in the foam sphere or hemispheres and a plane cut may be made in one of the hemispheres (or sphere) to create a piece of foam to fit in the lid as shown in FIG. 5. Note that there can be a plurality of spaced-apart cavities to accommodate the addition of exercise weights as shown in FIG. 6A or a plurality of cavities abutting each other as shown in FIG. 7A. Though the plurality of cavities abutting each other in FIG. 7A are shown as separate tubular cavities, in some embodiments, they may merge together and form a single cavity that may hold a plurality of weights. That is, there may not be any structures separating the inner parts of the cavities. FIGS. 6A and 7A show the cavities in one of the hemispheres of a medicine ball. The same cavities may be formed in either a in a single foam sphere with a lid cut off of a top portion, or may be contained partially within each of two equal hemispheres.

As will be discussed later in the disclosure, a greater overall unbalance in the ball may be created when exercise weights are placed in particular cavities in comparison to other cavities. For example, if two exercise weights are place in the cavities, one being placed in each of exercise cavities #1 and #2, the ball will have a greater percentage of unbalance as compared to if the same two exercise weights were to be place in exercise cavities #1 and #3. It is contemplated that as users desire to add more weight, they may do so one at a time. In order to minimize the overall percentage of unbalance, embodiments of medicine balls of the present disclosure may include user instructions on or inside the ball itself to show users a proper order in which to insert weights. For example, the instructions may indicate that a user should load the exercise weight cavities in the order of #1, #3, #2, #4.

The exercise weight cavity 36 may be created in the shape desired in the foam using means typical to those skilled in the art of working with foam such as knives, rotary tools, etc. The exercise weight cavity or cavities may have a shape and volume sufficient to accommodate the desired number and size of exercise weights. Though the exercise weight cavities shown throughout the figures have a distinct shape or shapes configured to hold a plurality of tubular exercise weights, exercise weight cavities according to the present disclosure may have a variety of different shapes. For example, the cavities could be rectangular, cubed, triangular, spherical, or any other suitable three-dimensional shape. Further, exercise weight cavities may comprise one single cavity or a plurality of cavities. For example, one embodiment of an exercise weight cavity may comprise a sphere in the middle of a ball, which may be configured to hold spherical exercise weights of one particular size but of varying weight.

Figure 8:
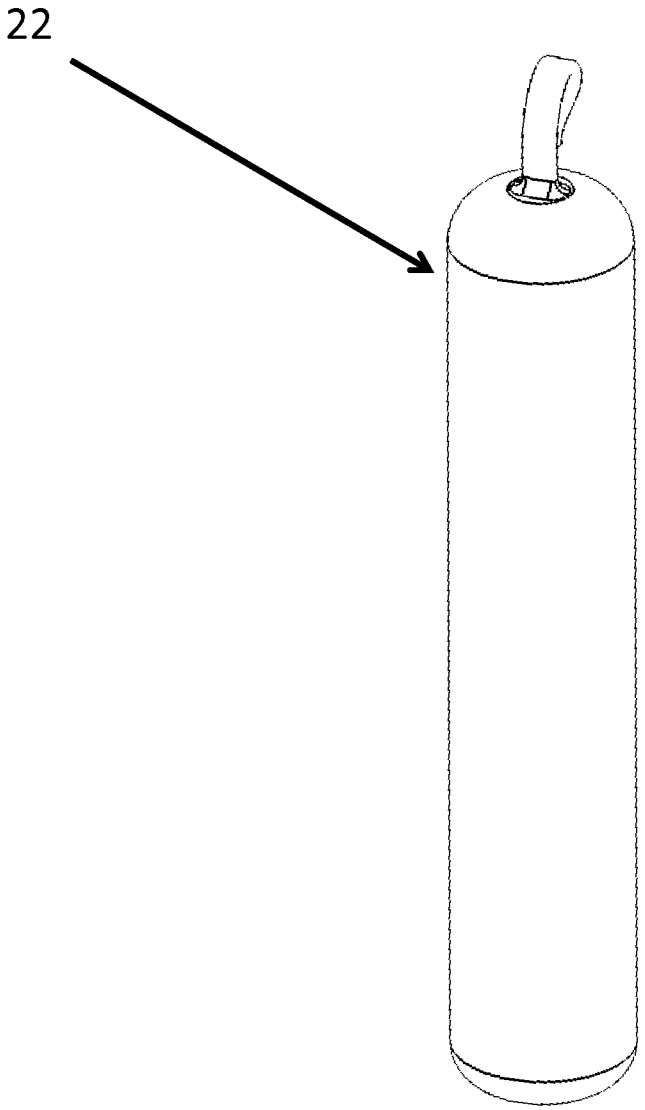
FIG. 8 illustrates an embodiment of a tubular exercise weight.

FIG. 8 shows an exercise weight in accordance with an embodiment of the disclosure. As shown, the exercise weights 22 have a circular tubular shape as well as a handle (number) for easily holding the weight and to help with insertion or removal into the exercise weight cavity. Similarly to the exercise weight cavities, the exercise weights themselves can be different shapes, for example, rectangular, cubes, spherical, or any other suitable shape. The exercise weights do not have to have a handle or grabbing attachment method attached to them.

The walls of the foam cavity or cavities can be left in their original condition after the cavity is created or the foam walls can be treated in a way to those familiar to those skilled in the art of working with foam by heating or applying chemicals or using tools to create smooth or textured surfaces as desired or a receptacle can be inserted into the cavity. When no receptacle is used, treated walls help maintain the size and shape of the cavity or cavities as well as to facilitate insertion and removal of the exercise weights and keep them from moving around when the ball is being used.

Figure 9:
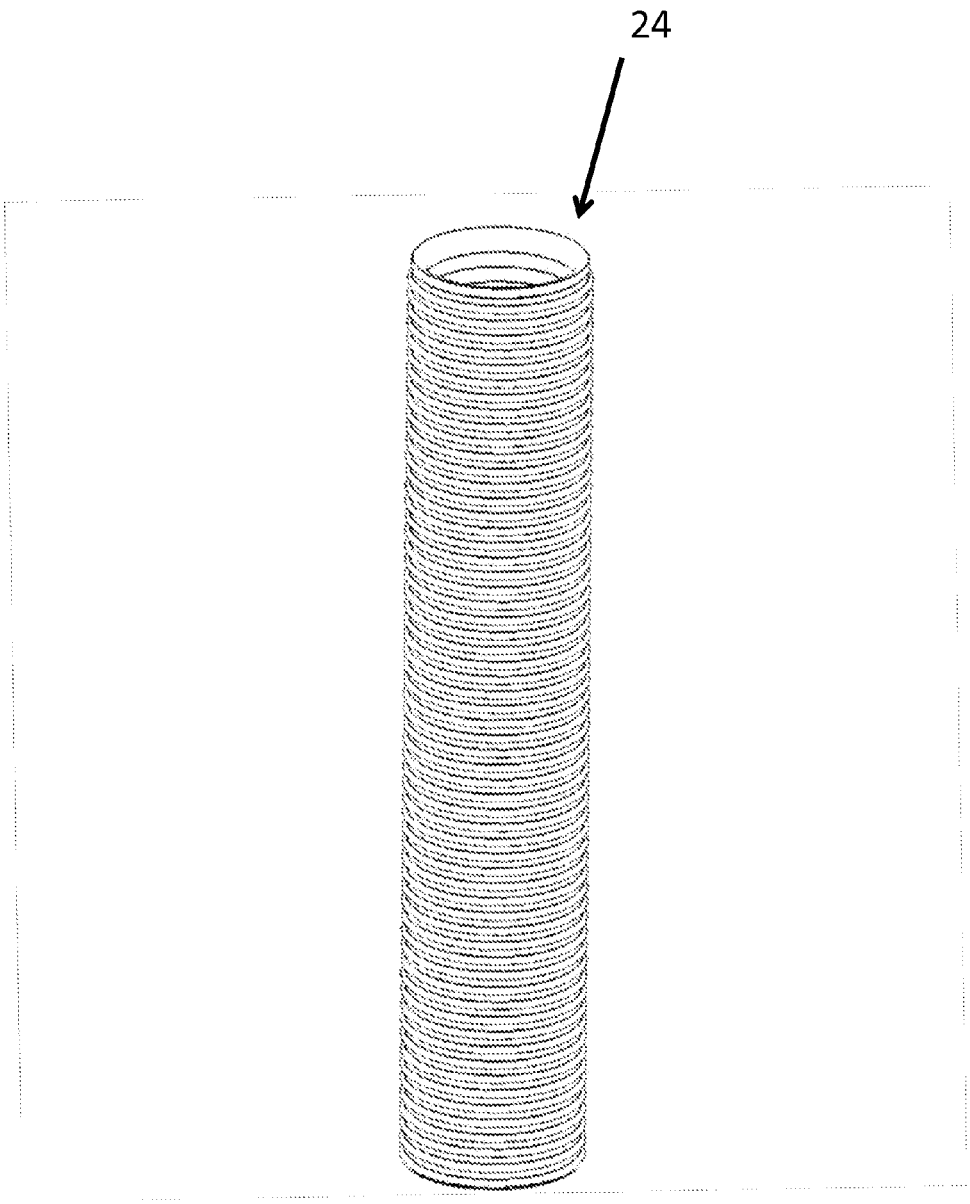
FIG. 9 illustrates an embodiment of a receptacle for a tubular exercise weight.

In some embodiments, the exercise cavity or cavities may contain a receptacle for the exercise weights. A receptacle 24 is depicted in FIG. 9. The receptacle 24 may serve to maintain the necessary cavity size and shape to insert the exercise weights into as well as a textured surface for the exercise weights to slide on when they are inserted. The textured surface may facilitate both sliding the weights in as well as to help eliminate their movement during exercise. The receptacle can be made out of one piece of material, which may be accomplished in any number of ways by one skilled in the art (for example, by injection molding plastic to create a shape with an interior cavity bounded by exterior walls that are in the shape of the exercise weight cavity or cavities) or by individual pieces or material such as tubing or other shapes. However, as one skilled in the art will realize, the receptacle can be made in many ways to create a receptacle of sufficient shape and size to hold the desired number of exercise weights to accommodate whatever shape exercise weights are used (e.g. tubes, cylinders, or some other shape).

In many embodiments there may be a single exercise weight cavity centered about the geometric center of the medicine ball in a shape as shown, for example, in FIG. 5. In these embodiments, a receptacle may be inserted into the single cavity to allow for the addition of the desired number of exercise weights. In many embodiments, the exercise weight receptacle 24 is formed by multiple pieces of tubing, see FIG. 1. If tubing is used, the tubing can be rigid or flexible, or smooth or corrugated depending on the desired properties for firmness and/or flexibility of the medicine ball. The tubing can be circular or other shapes in cross-section. In the embodiment shown in FIG. 9, the tubing is corrugated with a circular cross-section to allow for ease in inserting the exercise weights. The ridges and gaps in the corrugated tubing create spaces that engage the ends of the exercise weights helping keep them from moving during exercise. The corrugated tubing may also move when it experiences side or end forces which make the presence of added weights less noticeable when the ball is caught by a user.

The pieces of tubing can be left separate or joined together. If joined together, they may be joined by any number of processes familiar to those skilled in the art such as chemical bonding, heating/melting, wrapping/tying with material such as string, tape, zip-ties, etc. in the desired orientation. In one embodiment the four tubes are joined together by zip-ties.

A method to set the base empty weight of the medicine ball and the number and location of the balance weights will now be disclosed. The method may first comprise determining a final desired base "empty" weight of the ball. Then the method may comprise choosing all of the interior components to help meet this weight. The mass and number of the balance weights is then set to reach the desired empty weight of the ball.

If desired, a target weight for this process is set below the desired final weight goal. This is because the variability inherent in any manufacturing process means the weight of the components will vary slightly. To account for this variation, the target ball weight is set lower so that when the ball is assembled, it can be weighed and a final weight added (if needed) at a desired location to achieve the final desired weight for the medicine ball within a desired accuracy.

The components that must be established include the radius of the medicine ball (or equivalently the circumference or diameter), shell main body 12, shell lid 14, flexible closure 16, filling material 18, and receptacle(s) for exercise weight 24 (if a receptacle is used).

The following names will be assigned to the following variables to use in subsequent calculations:

CircumMedBall=circumference of the medicine ball, (inches)

RadMedBall=radius of the medicine ball 10, (inches)

RadMedball=CircumMedBall/(2*Pi)

Pi=numerical constant=3.14156

WtMedBall=desired final base (empty) weight of the medicine ball 10, (measured in lb)

WtShellFlex=weight of the combined shell main body 12, shell lid 14, and flexible closure 16 components (lb)

WtFillMatl=weight of the filling material 18, (lb)

WtRecept=weight of the receptacle for exercise weights 24, (lb)

NumExWt=number of exercise weights 22, (integer)

WtExWt=weight of each exercise weight 22, (lb)

WtAllBalWt=weight of all balance weights, (lb)

NumBalWt=number of balance weights, (integer)

WtBalWt=weight of each balance weight 20, (lb)

where

WtBalWt=WtAllBalWt/NumBalWt, (lb)

WtMedBall=WtShellFlex+WtFillMatl+WtRecept+WtAllBalWt

Or

WtAllBalWt=WtMedBall−WtShellFlex−WtFillMatl−WtRecept

Consider Example#1. In this example it is desired to make a medicine ball with a 7.16 inch radius (45" circumference) with a desired empty weight of the ball of eight (8) lb, capable of having four (4): two (2) lb exercise weights 22 added. This would result in a medicine ball having a base empty weight of 8 (eight) lb and a maximum weight of 16 (sixteen) lb. It will first be determined if the desired empty weight of 8 lb can be met with the weight of the following components: shell, flexible closure, receptacle, and filling material alone. If not, balance weights will need to also be added to reach the desired minimum weight.

One skilled in the art understands that different numbers and increments of exercise weights could be used resulting in a different maximum ball weight (for example 3-3 lb. weights or 4-1 lb. weights, etc.). One skilled in the art also understands that the exercise weights need not be of the same weight (e.g. any combination of 2 lb and 1 lb exercise weights could be used given sufficient room in the medicine ball).

Experience and testing showed that a typical combined weight of the shell main body 12, shell lid 14, flexible closure 16 is approximately one (1) lb. Experience and testing showed that in an embodiment, the receptacle can be made from multiple pieces of tubing having a combined weight of 0.5 lb. One skilled in the art understands that other weights could be used for these components but the process being disclosed remains the same.

The following variables are now set:

CircumMedBall=45 in

RadMedBall=CircumMedBall/(2*Pi)=45/(2*3.14156)=7.16 inch

WtMedBall=8.0 lb.

WtShellFlex=1.0 lb.

WtRecept=0.5 lb.

NumExWt=4

WtExWt=2.0 lb.

To this point the weight of the medicine ball is:

WtMedBall=WtShellFlex+WtFillMatl+WtRecept+WtAllBalWt

WtMedBall=1.0+WtFillMatl+0.5+WtAllBalWt

WtMedBall=1.5+WtFillMatl+WtAllBalWt

It will now be determined if the weight of the fill material alone can meet the desired medicine ball weight of 8 lb. or if balance weights will also need to be used. In the preferred embodiment the filling material 18 is made from a polyurethane foam but as noted earlier it can be made from other materials and suitable methods can be used to determine the weight of the desired filling material. In this case, the weight of the foam filling material (WtFillMatl) is the product of the density of the foam (FoamDensity) times the foam volume (FoamVolume):

WtFillMatl=FoamDensity*FoamVolume (lb.)

FoamDensity=density of foam, (lb./$ft^3$)

FoamVolume=volume of sphere having a radius of RadMedBall ($ft^3$)

FoamVolume=4*Pi*(RadMedBall$^3$)/3)/(12*12*12) $ft^3$

So for this example:

FoamVolume=(4*Pi*(7.16$^3$)/3)/(12*12*12)=1,538 $in^3$/(12*12*12 $in^3/ft^3$)

FoamVolume=0.89 $ft^3$

Typical values of foam density range from 0.5 lb/$ft^3$ (low quality foam having a shorter life) to greater than 2.0 lb/$ft^3$ (high quality foam having a longer life). Consider the case where the foam density is:

FoamDensity=0.93 lb/$ft^3$

Then the weight of the fill material (WtFillMatl) is:

WtFillMatl=FoamDensity*FoamVolume=0.93*0.89=0.83 lb.

So now the weight of the medicine ball with the fill material having a density of 0.93 lb/$ft^3$ is:

WtMedBall=1.5+0.83+WtAllBalWt=2.33+WtAllBalWt lb.

So the weight of the medicine ball without any balance weights is 2.33 lb., well below the desired weight of 8 lb. This means balance weights will likely be needed to achieve the desired empty weight of eight (8) lb. But before balance weights are added, the option of using a denser foam will be examined first.

Consider Example#2 where all parameters except the foam density remain the same. Instead a denser foam will be used with a foam density of 2.17 lb/$ft^3$, slightly greater than the preferred minimum foam density of 2.0 lb./$ft^3$:

FoamDensity=2.17 lb./$ft^3$

Then the weight of the fill material (WtFillMatl) is:

WtFillMatl=FoamDensity*FoamVolume=2.17*0.89=1.93 lb

So now the weight of the medicine ball with the fill material having a density of 2.17 lb/$ft^3$ is:

WtMedBall=1.5+1.93+WtAllBalWt=3.43+WtAllBalWt lb.

So the weight of the medicine ball without any balance weights is now 3.43 lb. using the 2.17 lb/$ft^3$ fill material, still well below the desired weight of 8 lb. Unless a much denser filling material is used, balance weights will need to be added.

The total weight of the balance weights needed to achieve the desired medicine ball weight of 8 lb., using the 2.17 lb./$ft^3$ fill material, can be found by rearranging the last equation in [00053]:

WtMedBall=1.5+1.93+WtAllBalWt=3.43+WtAllBalWt lb.

to

WtAllBalWt=WtMedBall−3.43

Substituting in the desired WtMedBall=8 lb.

WtAllBalWt=8−3.43=4.57 lb.

If the number of balance weights to be used was chosen as six then:

NumBalWt=6

And the weight of each of the 6 (six) balance weights is:

WtBalWt=WtAllBalWt/NumBalWt=4.57/6=0.76 lb.

In summary, this process has outlined how to size a medicine ball that requires the use of balance weights since the desired weight of 8 lb. was not achievable given the weights of the desired shell, flexible closure and filling material. In summary, the desired variable weight medicine ball in this Example#2 will have these properties:

CircumMedBall=45 (inches)

RadMedBall=7.16 (inches)

WtMedBall=8 (lb.)

WtShellFlex=1.0 (lb.)

FoamDensity=2.17 lb/$ft^3$

WtFillMatl=1.933 (lb.)

WtRecept=0.50, (lb.)

WtAllBalWt=4.57, (lb.)

NumBalWt=6

WtBalWt=0.76, (lb.)

With the choice of:

NumExWt=4

WtExWt=2.0 lb.

It should be noted that this calculation can be refined further by one skilled in the art in any number of ways to make it more accurate to the desired level for a desired outcome. For example, if it was desired to determine the weight of the balance weights more accurately, the volume of the filling material could be made more accurate by subtracting the volume of the receptacle (or the volume of the cavity to house the exercise weights) and/or subtracting the volume of the balance weight cavities (if used). If these volumes were subtracted from the filling material volume, the total balance weight would increase and be determined more accurately.

The next step is to illustrate how to determine the resulting unbalance, or "wobble," of the medicine ball when the weights (balance and exercise) are added at a given location. This disclosure will then show how to set the location of the balance weights. This will illustrate the process needed to vary the number and location of the exercise weights, number and location of the balance weights, and density of the filling material until the imbalance is at the desired level. Of course the other remaining variables such as shell weight or receptacle weight (if used) can be varied but will be left constant for the purposes of this example.

The unbalance is defined as the distance of the center of gravity of all components in the medicine ball from the geometric center of the medicine ball along each Cartesian coordinate axis x, y, and z.

$$Dbar_{X,Y,Z} = \frac{\sum_i d_i m_i}{\sum_i m_i}$$

where

Dbar_X,Y,Z=component unbalance=distance of the center of gravity of each medicine ball component from the geometric center of the medicine ball along each Cartesian coordinate axis X, Y, and Z (inches)

i=number of medicine ball components (integer)

di=distance of each medicine ball component's center of gravity from the geometric center of the medicine ball along each Cartesian coordinate axis X, Y, and Z (inches)

mi=mass or weight of each medicine ball component (lb.)

Only the components whose component center of gravity does not coincide with the geometric center of the medicine ball cause an unbalance. If the outer surface of the medicine ball is spherical, then the geometric center of the ball is located at the center of the sphere, i.e. the point where the radius is zero (0). It is contemplated that a medicine ball according to the present disclosure may be substantially spherical, and not necessarily perfectly spherical, given that the materials comprising the outer shell and the filling material may be compressed and/or stretched at any given point such that the medicine ball is not perfectly spherical. Throughout this disclosure, the terms "sphere" and "spherical" may be understood to also include shapes that are substantially spherical. For the purposes of this disclosure, the geometric center of the medicine ball is located at the origin of the Cartesian X,Y,Z coordinate system and has coordinates (0,0,0).

For example, the filling material can be treated as a sphere whose origin is located at the geometric center of the medicine ball. The distance of a sphere's center of gravity, di, from the geometric center of the medicine ball along each Cartesian axis X,Y, and Z is zero. But consider the effect of an object, say an exercise weight, located somewhere in a spherically shaped ball. If the center of gravity of the weight is not located at the geometric center of the ball at coordinates (0,0,0), then the ball will be unbalanced and wobble when thrown.

In the following examples, the method to determine unbalance will be illustrated using a spherically shaped ball and a single weight added to the interior of the ball. One skilled in the art understands that more detailed models including any desired number of components can be used to determine the unbalance. This analysis assumes that the unbalance can be calculated solely on the location of the center of gravity of each component. One skilled in the art recognizes that an integral analysis could be conducted to account for the finite dimensions of each component when calculating the unbalance but the final conclusions would not change. More detailed examples will be provided later in this disclosure.

Each component in the medicine ball can be represented by standard objects such as tubes, spheres, etc. For example, the filling material can be represented as a sphere in which the sphere's center of gravity is coincident with the geometric center of the medicine ball at coordinates (0,0,0). A tubular exercise weight, as shown in FIG. 8, can be represented as a tubular rod of length L and outer radius Ro. The center of gravity of a vertically oriented tubular rod lies at the mid-point of the length L and at an inner radius of zero.

Consider Example #3, and FIG. 6A, which may be used to illustrate how the unbalance of an exercise weight 22 in a ball is determined. The exercise weight 22 is represented as a tubular rod located in the interior of a sphere (i.e. a ball), as shown in FIG. 6A. In this case, a sphere comprised of filling material 18 is formed by putting two hemispheres of filling material 18 together along the X-Y plane. The tubular rod is oriented vertically (parallel to the Z axis) and the mid-point of the rod is on the X-Y plane shown in FIG. 6A, in the center of exercise weight cavity 36—Cavity #1. The center of gravity of this tubular rod would be located at the Cartesian coordinate position X,Y,Z=(0,−3.0,0). This is because the center of gravity of the four exercise weight cavities 36 in the filling material are located at a radius of 3.0 inches in the X,Y plane with the center of each cavity located along either the X or Y coordinate axis. In this configuration of exercise cavities, the geometric center of the exercise cavities shown in the configuration of FIG. 6A are located at the following coordinates:

| Cavity# | X Coordinate | Y Coordinate | Z Coordinate |
|---|---|---|---|
| 1 | 0.0 | −3.00 | 0.0 |
| 2 | 3.00 | 0.0 | 0.0 |
| 3 | 0.0 | 3.00 | 0.0 |
| 4 | −3.00 | 0.0 | 0.0 |

A table can be created for the distance of each component's center of gravity from the geometric center of the medicine ball, in each coordinate direction. For the sphere and the tubular rod in exercise weight cavity #1, discussed above, the table would be:

| Medicine Ball Component | di in X direction | di in Y direction | Di in Z direction |
|---|---|---|---|
| i = 1: Sphere | 0 | 0 | 0 |
| i = 2: Tubular Rod (in Cavity #1) | 0 | −3.0 | 0 |

Based on the example in the table above, the unbalance for a ball (sphere) of mass m1 at a weight of 3 lb. containing a tubular rod of mass m2 at a weight of 1 lb. located in Cavity#1 in the interior of the sphere as discussed in [00062] can be calculated for each coordinate direction. For the X coordinate direction:

Dbar_X=(d1x*m1+d2x*m2)/(m1+m2)=(0*3+0*1)/(3+1)=0 inches

For the Y coordinate direction:

Dbar_Y=(d1y*m1+d2y*m2)/(m1+m2)=(0*3+−3*1)/(3+1)=−¾=−0.75 inches

For the Z coordinate direction:

Dbar_Z=(d1z*m1+d2z*m2)/(m1+m2)=(0*3+0*1)/(3+1)=0 inches

Figure 6B:
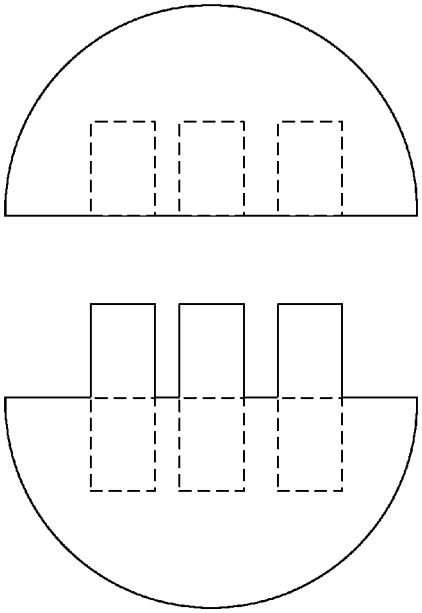
FIG. 6B illustrates the medicine ball of 6A from a side view of two hemispheres with exercise weights occupying the exercise weight cavities shown in FIG. 6A.

Thus, the unbalance of a 3 lb. ball with a 1 lb. weight in Cavity#1 of FIG. 6 can be represented as (0,−0.75,0) inches or −0.75 inches along the Y coordinate axis. This means the center of gravity of the combined ball and tubular rod is located at (0,−0.75,0) whereas the geometric center of the sphere is located at (0,0,0). This means that when the ball (i.e. sphere) is thrown, the ball will wobble as it rotates due to the unbalance along the Y axis.

Consider a second example, Example#4. In this example, the unbalance of an exercise weight 22 located in a ball is determined but the weight is at a different location than Example#3. If the 1 lb. tubular rod was instead placed in exercise weight cavity 36, Cavity#2 shown in FIG. 6A, the table for the distance of each components' center of gravity from the geometric center of the medicine ball, in each coordinate direction would become:

| Medicine Ball Component | di in X direction | di in Y direction | di in Z direction |
|---|---|---|---|
| i = 1: Sphere | 0 | 0 | 0 |
| 1 = 2: Tubular Rod (in Cavity #2) | +3.0 | 0 | 0 |

In the example described, the unbalance for a ball (sphere) of mass m1 at a weight of 3 lb. containing a tubular rod of mass m2 at a weight of 1 lb. located in Cavity #2 in the interior of the sphere as discussed above can be calculated for each coordinate direction. For the X coordinate direction:

Dbar_X=(d1x*m1+d2x*m2)/(m1+m2)=(0*3+3*1)/(3+1)=¾=0.75 inches

For the Y coordinate direction:

Dbar_Y=(d1y*m1+d2y*m2)/(m1+m2)=(0*3+0*1)/(3+1)=0 inches

For the Z coordinate direction:

Dbar_Z=(d1z*m1+d2z*m2)/(m1+m2)=(0*3+0*1)/(3+1)=0 inches

Thus, the unbalance of a 3 lb. ball with a 1 lb. weight in Cavity #2 of FIG. 6 can be represented as (0.75,0,0) inches or 0.75 inches along the X coordinate axis. This means the center of gravity of the combined ball and tubular rod is located at (0.75,0,0) whereas the geometric center of the sphere is located at (0,0,0). This again means when the ball (i.e. sphere) is thrown, the ball will wobble as it rotates due to the unbalance.

Comparing the two Examples #3 and #4, one notes that the absolute value of the unbalance was 0.75 inches in both examples but in different coordinate directions.

It will be recognized that an unbalance along the X axis creates moments about the Y and Z axes as the ball rotates. A moment is a measure of the tendency of a force acting on an object, to rotate the object about an axis or a specific point. The greater the moment, the greater the tendency of the force to rotate the object. In the case of the medicine ball, the force is the mass of one or more exercise weights causing the unbalance. The magnitude of a moment is found by the product of a mass (exercise weight) times the perpendicular distance (the unbalance) to the geometric center of the medicine ball. These moments create the wobble. In a similar fashion, the unbalance along the Y axis creates moments about the X and Z axes. And an unbalance along the Z axis creates moments about the X and Y axes. Unbalances along more than one coordinate axis create more complex moments and thus more pronounced wobbles.

However, the direction of the unbalance is not as significant as the magnitude of the unbalance from all directions. The magnitude of the unbalance from all directions, MagDbar is found by taking the square root of the sum of the unbalance squared in each coordinate direction:

$$\text{Mag}D\text{bar}=((D\text{bar_}X)^2+(D\text{bar_}Y)^2+(D\text{bar_}Z)^2)^{1/2}$$

Using this formula, the magnitudes of the unbalance for Examples #3 and #4 are found to be equal and have a value of 0.75:

$$\text{Mag}D\text{bar}=((0)^2+(-0.75)^2+(0)^2)^{0.5}=0.75 \text{ inches} \qquad \text{Example \#3:}$$

$$\text{Mag}D\text{bar}=((0.75)^2+(0)^2+(0)^2)^{0.5}=0.75 \text{ inches} \qquad \text{Example \#4:}$$

Consider Example #5 in which the unbalance for a ball (sphere) of mass m1=3 lb. is determined for two exercise weights located in a ball. In this example, a 1 lb. tubular mass is placed in both Cavity #1 (m2=1 lb.) and Cavity #2 (m3=3 lb.) of FIG. 6A. Such an example may occur in a case where a user wants to add two pounds total to the medicine ball by adding two (2)-one (1) lb. exercise weights. This will create an unbalance in two coordinate directions. The table for the distance of each component's center of gravity from the geometric center of the medicine ball, in each coordinate direction is:

| Medicine Ball Component | di in X direction | di in Y direction | di in Z direction |
|---|---|---|---|
| i = 1: Sphere | 0 | 0 | 0 |
| i = 2: Tubular Rod (in Cavity #1) | 0 | −3.0 | 0 |
| i = 3: Tubular Rod (in Cavity #2) | +3.0 | 0 | 0 |

Then the unbalance for a ball (sphere) of mass 3 lb. having a tubular rod of 1 lb. located in both Cavity #1 and Cavity #2 can be calculated for each coordinate direction. For the X coordinate direction:

Dbar_X=(d1x*m1+d2x*m2+d3x*m3)/(m1+m2+m3)=(0*3+0*1+3*1)/(3+1+1)=⅗=0.6 inches

For the Y coordinate direction:

Dbar_Y=(d1y*m1+d2y*m2+d3y*m3)/(m1+m2+m3)=(0*3+−3*1+0*1)/(3+1+1)=−⅗=−0.6 inches

For the Z coordinate direction:

Dbar_Z==(d1z*m1+d2z*m2+d3z*m3)/(m1+m2+m3)=(0*3+0*1+0*1)/(3+1+1)=0 inches

The magnitudes of the total unbalance for Example #5 is found to be:

$$\text{Mag}D\text{bar}=((0.6)\hat{}2+(-0.6)\hat{}2+(0)\hat{}2)\hat{}0.5=0.85 \text{ inches} \qquad \text{Example \#3:}$$

Thus the magnitude of the total unbalance is larger (i.e. worse) in Example #5: MagDbar=0.85," than either Example #3: MagDbar=0.75," or Example #4: MagDbar=0.75," and will be in a different direction than either Example #3 or Example #4. But the direction of the unbalance is immaterial.

When the ball is thrown, neither the orientation of the geometric center of the ball or the combined center of gravity or the unbalance is considered (or even known) by a user; a thrower simply throws the ball. A main disadvantage of an unbalance is that the unbalance in any one coordinate direction or combination of coordinate directions will cause a wobble.

Another consideration regarding the magnitude of imbalance is the magnitude of the unbalance in relation to the size (i.e. radius) of the medicine ball. In Examples #3, #4, and #5, the size (i.e. radius) of the ball was omitted. Empirical testing has shown that when the magnitude of the total unbalance (MagDbar) exceeds 20% (twenty percent) of the ball outer radius (RadMedBall) than the wobble is severe, making the ball difficult to throw and catch thus increasing the risk of injury. The percentage of unbalance is denoted by the variable PerCentUnbal and the severe level of unbalance can be expressed as:

$$PerCentUnbal = \frac{MagDbar}{RadMedBall} * 100 > 20\%$$

This disclosure shows how to make a medicine ball that limits the total maximum unbalance from any and all coordinate directions. In embodiments of an adjustable weight medicine ball of the present disclosure, the maximum total magnitude of unbalance is less than or equal to five percent (5%) of the medicine ball outer radius. This can be expressed as the percentage of unbalance being less than or equal to 5%:

$$PerCentUnbal = \frac{MagDbar}{RadMedBall} * 100 \leq 5\%$$

However, it is contemplated that an adjustable weight medicine ball with an unbalance greater than 5% (five percent) of the ball's outer radius, but less than 20% (twenty percent) may be acceptable in some applications. Therefore, embodiments with a desired unbalance between 5% and 20% may be made according to the methods presented in this disclosure.

If a medicine ball were made in the manners described in either Example #3 or Example #4, with a 3 lb. sphere and a 1 lb. exercise weight creating a magnitude of unbalance of MagDbar=0.75 inches, the percentage of unbalance, PerCentUnbal, for different radius balls, RadMedBall, can be calculated as:

| MagDbar (inches) | RadMedBall (inches) | PerCentUnbal (%) |
|---|---|---|
| 0.75 | 3.50 | 21.4 |
| 0.75 | 4.00 | 18.8 |
| 0.75 | 4.50 | 16.7 |
| 0.75 | 5.00 | 15.0 |
| 0.75 | 5.50 | 13.6 |
| 0.75 | 6.00 | 12.5 |
| 0.75 | 6.50 | 11.5 |
| 0.75 | 7.00 | 10.7 |
| 0.75 | 7.50 | 10.0 |
| 0.75 | 8.00 | 9.4 |
| 0.75 | 8.50 | 8.8 |
| 0.75 | 9.00 | 8.3 |
| 0.75 | 9.50 | 7.9 |
| 0.75 | 10.00 | 7.5 |
| 0.75 | 10.50 | 7.1 |
| 0.75 | 11.00 | 6.8 |
| 0.75 | 11.50 | 6.5 |
| 0.75 | 12.00 | 6.3 |
| 0.75 | 12.50 | 6.0 |
| 0.75 | 13.00 | 5.8 |
| 0.75 | 13.50 | 5.6 |
| 0.75 | 14.00 | 5.4 |
| 0.75 | 14.50 | 5.2 |
| 0.75 | 15.00 | 5.0 |
| 0.75 | 15.50 | 4.8 |
| 0.75 | 16.00 | 4.7 |

The above table illustrates the interplay between different radius balls having the same weight (3 lb.) and the same magnitude of unbalance (MagDbar=0.75 inches) and how the percentage of unbalance (PerCentUnbal) decreases as the medicine ball radius (RadMedBall) increases. From row one of the table, one can see that if a 3 lb. ball were created with a radius of 3.50 inches, than the percentage of unbalance would be 21.4% if the unbalance had a magnitude of 0.75 inches. Based on empirical testing, this would create a severe wobble since the calculated percentage of unbalance, 21.4%, is greater than 20%. Note that the specific dimensions of the component creating the unbalance don't need to be specified, just that the location and weight of the component create a center of gravity located such that the magnitude of unbalance is 0.75 inches. Now consider the row in the table where the radius of the ball is 15.0 inches (assuming the density of the material used to create the ball was decreased, resulting in a ball that still weighed 3 lb. but now had an outer radius of 15.0 inches). With the same unbalance of magnitude of 0.75 inches, the percentage of unbalance has now dropped to 5.0%, which is an ideal maximum unbalance. Thus, one can use this process to change the variables as desired to create a ball of desired radius and weight, containing components causing unbalance (such as exercise weights and balance weights) and create a final ball with a maximum preferred unbalance.

Another aspect of the disclosure is how balance weights may be located within the medicine ball if desired, in order to both increase the total weight of the ball and, as will be discussed later in this disclosure, to further minimize unbalance. As has been disclosed, the mass of the balance weights may be chosen to help set the base weight of the ball if the weight of the filling material is not sufficient to meet the desired weight of the medicine ball. In addition, the mass and location of the balance weights help limit the maximum unbalance. If balance weights are used, the same analysis to determine the magnitude of the unbalance disclosed above is used to determine the unbalance of the ball due to all components of the ball, including balance weights and exercise weights, etc. The variables, including number, weight, and location of balance weights, number, weight, and location of exercise weights, filling material density, etc., are changed until the percent of unbalance is reached for the desired ball radius.

The choice of the number of balance weights and their locations are established such that the center of gravity of the balance weights is located to make the magnitude of the unbalance for all components in the medicine ball at or below the desired level. In some embodiments, the location of the balance weights is chosen so that the center of gravity of the balance weights is at the geometric center of the medicine ball and are located as close to the shell 12 as is practical given manufacturing, user comfort, and other considerations. It may be advantageous locate the balance weights as close to the shell 12 (i.e., as far outward radially) as possible, because this will increase the moment of inertia of the base (empty) medicine ball. Consequently, the impact of adding exercise weights, preferably located as near the geometric center of the variable weight medicine ball as possible, will be lessened, making the increase in the moment of inertia due to the addition of exercise weights as low as possible. A higher moment of inertia is an additional advantage to the ball design of the present disclosure in addition to minimizing unbalance.

In other embodiments, balance weights may be located within the filling material such that the center of gravity of the balance weights is at a location other than the geometric center. An advantage of these embodiments would be to minimize the unbalance due to the number and location of exercise weights in a particular configuration, but they may also increase the unbalance of other exercise weight configurations.

If balance weights are used, the choice of the number of balance weights used can vary from one to many. For example, one weight could be located in a thin layer at a constant average radius near the periphery of the ball such that the weight forms an inner spherical shell. The inner spherical shell would be located as far close to the inner surface of the outer shell of the ball. An example of this embodiment is shown in FIG. 3, in which an inner shell 27 is a balance weight, and is located close to the outer shell 28. In such embodiments comprising a single inner spherical shell 27 as a balance weight, the firmness of the material may impact the feel of the medicine ball. Additionally, the ball may be constructed in a different manner than described above with reference to balance weight cavities. For example, the inner spherical shell may be disposed between separate layers of foam, and may have its own lid cut out to allow access to the exercise weight cavity.

In many embodiments, though, multiple balance weights are used and are placed in cavities created in the foam to accommodate the balance weights as disclosed above with reference to FIGS. 1, 2, and 5. In the embodiments depicted, the number of balance weights (and hence balance weight cavities) is six (6). FIGS. 10A and 10B show two orientations of balance weights disposed within a medicine ball. FIG. 10A shows a first oblique orientation of the medicine ball, with two of the weights located on each of the Cartesian axes, X, Y, and Z. Each of the balance weights are located equidistant from the geometric center of the filling material and along the Cartesian axes. For example, if the six (6) weights were desired to be located five inches (5.0") from the geometric center of the filling material (located at the X, Y, Z coordinates (0,0,0)) the center of gravity of the balance weights would be located along the coordinate axes and centered at the X, Y, Z coordinates as follows:

| X | Y | Z |
|---|---|---|
| −5.0 | 0.0 | 0.0 |
| +5.0 | 0.0 | 0.0 |
| 0.0 | −5.0 | 0.0 |
| 0.0 | +5.0 | 0.0 |
| 0.0 | 0.0 | −5.0 |
| 0.0 | 0.0 | +5.0 |

FIG. 10B shows a rotated view of the same ball and balance weights as FIG. 10A. The coordinate system of the six balance weights is rotated +45 degrees about the original Y axis and −45 degrees about the original X axis as shown in FIG. 10A. The center of the gravity of the six balance weights is still located at the located at the X, Y, Z coordinates (0,0,0), even though the Cartesian coordinate system of the balance weights has been rotated relative to the Cartesian coordinate system of the medicine ball. The balance weights as shown in FIG. 10B now lie in two planes equally spaced from a horizontal plane through the medicine ball center.

Turning now to FIGS. 11A-11C, shown are two top cross-sectional views, as seen from cross-sectional cuts 48 and 50 shown in FIG. 11A. FIG. 11B shows the orientation of all six balance weights in relation to each other, and FIG. 11C shows the orientation of the bottom three balance weights in relation to each other. As shown. in each plane, the balance weights are located approximately 120 degrees apart shown. In FIGS. 11A-11C, exercise weight cavities are omitted for clarity.

Figures 12A, 12B, 12C:
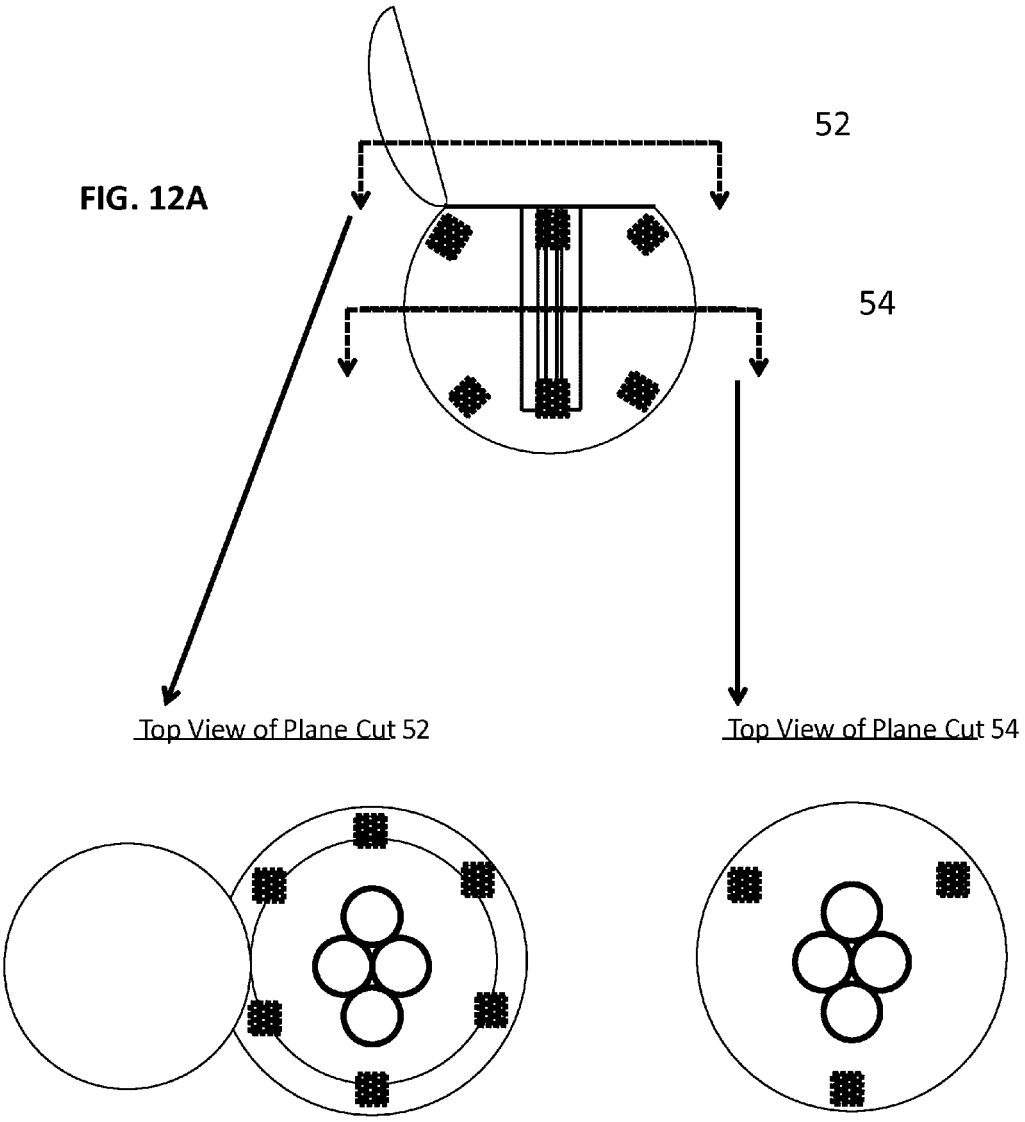
FIGS. 12A, 12B and 12C illustrate top cross-sectional views of an embodiment of a medicine ball with a lid opening, and show the location of several balance weights an exercise weight cavity.

FIGS. 12A-12C illustrate an embodiment of a medicine ball similar to that depicted in FIGS. 11A-11C, but shows an exercise cavity located at the geometric center of the filling material in addition to the six balance weights located along the rotated coordinate system. In the embodiment shown, the shell closure 16 and shell lid 14 are located above the top layer of three balance weights as shown in FIGS. 1 and 2. In these embodiments, only filling material (and not balance weights) comprises the inside of the shell lid 14.

Consider another example, Example #6, in which balance weights are used to set the weight of the medicine ball as well as to determine the unbalance based on the weight and location of the balance weights. In this example, the medicine ball parameters from previous examples are used, and each exercise weight 22 weighs 2 lb. The exercise weight cavities remain in the same locations as shown in FIG. 6A, which are at a 3 inch radius from the geometric center of the filling material in the X,Y plane. The properties for the variable weight medicine ball are repeated here:

CircumMedBall=45 (inches)
RadMedBall=7.16 (inches)
WtMedBall=8 (lb.)
WtShellFlex=1.0 (lb.)
FoamDensity=2.17 lb./ft$^3$
WtFillMatl=1.933 (lb.)
WtRecept=0.50, (lb.)
WtAllBalWt=4.57, (lb.)
NumBalWt=6
WtBalWt=0.76, (lb.)
With the choice of:
NumExWt=4
WtExWt=2.0 lb.

A table can be created for the distance of each component's center of gravity from the geometric center of the medicine ball, in each coordinate direction. Consider the case where there is a 2 lb. exercise weight in Cavity #1 of FIG. 6A. For the components in Example #6 the table would be:

| Medicine Ball Component | di in X Direction | di in Y direction | di in Z direction |
|---|---|---|---|
| Filling Material (Sphere) | 0 | 0 | 0 |
| Shell | 0 | 0 | 0 |
| Receptacle | 0 | 0 | 0 |
| Balance Weights | 0 | 0 | 0 |
| Exercise Weight (in Cavity #1) | 0 | −3.0 | 0 |

Note that because the center of gravity of the filling material, shell, receptacle components, and balance weights in the medicine ball lie at the geometric center of the ball, the di for each of them is zero (0) in each coordinate direction X, Y, and Z. The center of gravity for the balance weights is located at the center of the ball because each pair lies equidistantly on the axes from each other and balance each other out. The center of gravity of the exercise weight, in contrast, lies at (0,−3,0) (which is off of the geometric center of the ball) when it is in Cavity #1 of FIG. 6A. Using the same process outlined in Examples #3, #4, and #5, the magnitudes of unbalance for this configuration is found to be:

| Exercise Cavity Containing an | Example #6 Center of Gravity Single Exercise Weight Configuration | | | | |
|---|---|---|---|---|---|
| Exercise Weight | Dbar_X (in) | Dbar_Y (in) | Dbar_Z (in) | MagDbar (in) | PerCentUnbal |
| 1 only | 0.00 | −0.60 | 0.00 | 0.60 | 8.4% |

These results show that there is an unbalance magnitude of MagDbar=0.60 inches due to a single unbalance in the Y direction (Dbar_Y=−0.60 inches). This unbalance is 8.4% of the medicine ball radius of RadMedBall=7.16 (inches), or PerCentUnbal=100*(0.60)/(7.16)=8.4%. This amount of unbalance is well below the 20% threshold for severe wobble but is still larger than a preferable maximum percent of unbalance of 5%. An amount of unbalance greater than 5% and less than 20% may be acceptable in some products, but often, a smaller percentage of unbalance is more advantageous. Further examples will show how to decrease the amount of unbalance to be equal to or less than 5%.

Other configurations of locations of the exercise weights can be considered for the four cavities shown in FIG. 6A. For example, a user could insert an exercise weight in Cavity #2, or insert two exercise weights, one each in in Cavities #2 and

#4. Several common arrangements of one or more exercise weights in cavities are shown in the table below. Other cases are not shown because they are equivalent geometrically.

| Exercise Cavity Containing 2 lb | Example #6 Center of Gravity Multiple Exercise Weight Configurations | | | | |
|---|---|---|---|---|---|
| Exercise Weight | Dbar_X (in) | Dbar_Y (in) | Dbar_Z (in) | MagDbar (in) | PerCentUnbal |
| 1 only | 0.00 | −0.60 | 0.00 | 0.60 | 8.4% |
| 2 only | 0.60 | 0.00 | 0.00 | 0.60 | 8.4% |
| 2, 4 | 0.00 | 0.00 | 0.00 | 0.00 | 0.0% |
| 1, 2 | 0.50 | −0.50 | 0.00 | 0.71 | 9.9% |
| 1, 3 | 0.00 | 0.00 | 0.00 | 0.00 | 0.0% |
| 1, 2, 4 | 0.00 | −0.43 | 0.00 | 0.43 | 6.0% |
| 1, 2 ,3, 4 | 0.00 | 0.00 | 0.00 | 0.00 | 0.0% |

These results show that the largest magnitude of unbalance is 0.71 inches when 2 lb. exercise weights are in Cavities #1 and #2 (or an equivalent location) resulting in a 9.9% unbalance. Again, this amount of unbalance may be acceptable in some products but not in others.

Now consider Example #7, in which the design is changed in order to reduce the largest percentage of unbalance to be less than or equal to 5% by changing the location of the exercise cavities. Everything remains the same as in Example #6 except the exercise cavity locations are brought closer to the geometric center of the medicine ball as shown in FIG. 7A. In this configuration of exercise cavities, the geometric center of the exercise cavities are located at the following coordinates:

| Cavity # | X Coordinate | Y Coordinate | Z Coordinate |
|---|---|---|---|
| 1 | 0.0 | −1.65 | 0.0 |
| 2 | 0.94 | 0.0 | 0.0 |
| 3 | 0.0 | 1.65 | 0.0 |
| 4 | −0.94 | 0.0 | 0.0 |

Using the same process outlined in Example #6, the magnitudes of unbalance for this Example #7 configuration are found to be:

| Exercise Cavity Containing a | Example #7 Center of Gravity Multiple Exercise Weight Configurations | | | | |
|---|---|---|---|---|---|
| 2 lb Exercise Weight | Dbar_X (in) | Dbar_Y (in) | Dbar_Z (in) | MagDbar (in) | PerCentUnbal |
| 1 only | 0.00 | −0.33 | 0.00 | 0.33 | 4.6% |
| 2 only | 0.19 | 0.00 | 0.00 | 0.19 | 2.6% |
| 2, 4 | 0.00 | 0.00 | 0.00 | 0.00 | 0.0% |
| 1, 2 | 0.16 | −0.28 | 0.00 | 0.32 | 4.4% |
| 1, 3 | 0.00 | 0.00 | 0.00 | 0.00 | 0.0% |
| 1, 2, 4 | 0.00 | −0.24 | 0.00 | 0.24 | 3.3% |
| 1, 2, 3, 4 | 0.00 | 0.00 | 0.00 | 0.00 | 0.0% |

These results show that the largest unbalance is now only 0.33 inches (when a 2 lb. exercise weight is in Cavity #1) resulting in a 4.6% unbalance which is now below the target maximum unbalance of 5%. Note the magnitude of unbalance when 2 lb. exercise weights are in each of Cavities #1 and #2 is nearly as large at 4.4%. It should also be noted that these results did not have the same symmetry as the results in Example #6 because the exercise weight cavities are not located symmetrically about the geometric center of the medicine ball. It is contemplated that other locations for the exercise cavities different than those shown in FIG. 6A and FIG. 7A that would satisfy the preferred percentage of maximum unbalance of 5% because of the difference in distances of the locations of the exercise cavities in the two examples from the geometric center of the ball located at (0,0,0).

Examples #6 and #7 also show why it may be advantageous to have the number of exercise weight cavities be exactly four. The advantage is due to symmetry: when four exercise cavities are arranged either completely symmetrical about the origin in the X,Y plane as shown in FIG. 6A or symmetric about two axes as shown in FIG. 7A, then when two exercise weights are in "mirror" positions (e.g., Cavity#1 and #3, or Cavity #2 and #4), then the resulting unbalance for this configuration of exercise weights is zero. When the configuration of exercise weights is not symmetric—i.e. there is only one exercise weight (e.g. located in Cavity #1 or Cavity #2) or the exercise weights are not in a "mirror image" configuration (e.g. exercise weights are located in both Cavity #1 and #2 or in Cavities #1, #2, and #3)—then the highest levels of unbalance will occur. Using an odd number of exercise weights will increase the number of occurrences of non-zero unbalance. But a variable weight medicine ball with some magnitude of unbalance can be obtained but the target maximum amount of 5% may not be achievable due to the asymmetry in the location of the exercise weights, though values of unbalance between 5-20% are still possible.

In the following Example 8A it will be shown why simply adding weights to a ball of filling material without the use of balance weights, which is one embodiment of a variable weight medicine ball, can be very undesirable. It will be shown that it is undesirable because of the high amount of unbalance that occurs, increasing the chance of injury. The filling material in this example is foam, but one skilled in the art realizes that the type of filling material can be different. It is the density of the filling material that matters in this analysis, not the actual material choice. In this example no balance weights will be used. Only two variables will be altered, which are the filling material density (0.93 lb./ft$^3$ and 2.17 lb./ft$^3$) and the location of the exercise cavities (i.e., the exercise weight configurations as shown in FIG. 6A and FIG. 7A). The same process will be followed as in Examples #6 and #7 to determine the maximum percent unbalance for which configuration of exercise weights that occurs in the medicine ball. The following variables will be remain the same as in Examples #6 and #7:

CircumMedBall=45 (inches)

RadMedBall=7.16 (inches)

WtMedBall=dependent upon density of filling material (lb.)

WtShellFlex=1.0 (lb.)

FoamDensity=either 0.93 lb./ft$^3$ and 2.17 lb./ft$^3$, see table below

WtFillMatl=dependent upon density of filling material (lb.)

WtRecept=0.50, (lb.)

WtAllBalWt=0.0 (lb.)

NumBalWt=0

WtBalWt=0.0 (lb.)

With the choice of:

NumExWt=4

WtExWt=2.0 lb.

The table below shows the maximum percent unbalance (and exercise weight configuration for which the maximum unbalance occurs) for the parameters listed above.

Example#8A

Figure 7B:
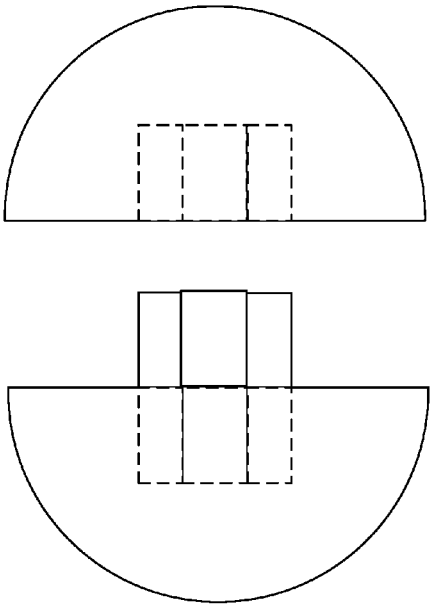
FIG. 7B illustrates the medicine ball of FIG. 7A from a side view of two hemispheres with exercise weights occupying the exercise weight cavities shown in FIG. 7A.

| | | MAXIMUM PERCENT UNBALANCED No Balance Weights 2 lb Exercise Weights Exercise Weight Location | |
|---|---|---|---|
| | | FIG. 6 (3" radius) | FIG. 7 (Center) |
| FOAM DENSITY (lb/ft^3) | 0.93 | 19.4% @ 1 only (Total Wt = 2.33 lb) (Foam Wt = 0.83 lb) | 10.6% @ 1 only (Total Wt = 2.33 lb) (Foam Wt = 0.83 lb) |
| | 2.17 | 15.4% @ 1 only (Total Wt = 3.43 lb) (Foam Wt = 1.93 lb) | 8.5% @ 1 only (Total Wt = 3.43 lb) (Foam Wt = 1.93 lb) |

The results show the maximum unbalance varying from 19.4% (foam density of 0.93 lb./ft$^3$ with exercise weights as shown in FIG. 6A) to 8.5% (foam density of 2.17 lb./ft$^3$ with exercise weights as shown in FIG. 7A). Medicine balls with this range of unbalance will exhibit mild (8.5%) to moderate (19.4%) wobble when thrown and may increase the chance of injury. Thus. as the foam density increases, the foam mass increases which increases the total weight of the medicine ball which reduces the unbalance due to the addition of the exercise weight(s). The results also show that as the exercise weights are added closer to the geometric center of gravity of the ball (i.e. exercise weight configuration shown in FIG. 7A) the unbalance is reduced from when the exercise weights are located further from the geometric center of gravity of the ball (i.e. the exercise weight configuration shown in FIG. 6A). In addition, the exercise weight configuration showing the maximum unbalance is where a weight is added to Exercise Cavity #1 in all four configurations of medicine balls. It should also be noted that the base weight of medicine balls (i.e. before additional exercise weights are added) in this example are either 2.33 lb. or 3.43 lb. This weight medicine ball may be suitable for someone recovering from an injury or for a child, or anyone requiring a medicine ball with an initial weight of less than four (4) lb. In this example, 2 lb. exercise weights were added which may be too large for someone requiring a medicine ball with an initial weight this low.

Now consider Example #8B in which everything remains the same as Example #8A except lower weight exercise weights are used. In this example, 1 lb. exercise weights are used instead of the 2 lb. exercise weights used in Example #8A. The only change in variables in the present examples is that now:

NumExWt=4

WtExWt=1.0 lb

Example #8B

| | | MAXIMUM PERCENT UNBALANCED No Balance Weights 1 lb Exercise Weights Exercise Weight Location | |
|---|---|---|---|
| | | FIG. 6 (3" radius) | FIG. 7 (Center) |
| FOAM DENSITY (lb/ft^3) | 0.93 | 13.7% @ 1, 2 (Total Wt = 2.33 lb) (Foam Wt = 0.83 lb) | 6.9% @ 1 only (Total Wt = 2.33 lb) (Foam Wt = 0.83 lb) |
| | 2.17 | 10.9% @ 1, 2 (Total Wt = 3.43 lb) (Foam Wt = 1.93 lb) | 5.2% @ 1 only (Total Wt = 3.43 lb) (Foam Wt = 1.93 lb) |

The results show the maximum unbalance varying from 13.7% (foam density of 0.93 lb/ft$^3$ with exercise weights as shown in FIG. 6A) to 5.2% (foam density of 2.17 lb/ft$^3$ with exercise weights as shown in FIG. 7A). Medicine balls with this range of unbalance will exhibit very little (5.2%) to moderate (13.7%) unbalance. As before, as the foam density increases, the foam mass increases, which increases the total weight of the medicine ball, which in turn reduces the unbalance due to the addition of the exercise weight(s). The results again show that as the exercise weights are added closer to the geometric center of gravity of the ball (e.g., as shown in FIG. 7A) the unbalance is reduced from when the exercise weights are located further from the geometric center of gravity of the ball (e.g., as shown in FIG. 6A). However, in this example, the exercise weight location showing the maximum unbalance depends on the exercise weight cavity configuration. The reduction in exercise weight from 2 lb. to 1 lb. means that it takes the addition of two exercise weights to cause the most unbalance (exercise weights in Exercise Cavity "1, 2") for the exercise weight configuration locations as shown in FIG. 6A. It should be noted (though not shown here) that the exercise weight configuration with the second highest unbalance is "1 only" for exercise weights in FIG. 6A. When exercise weights are configured as shown in FIG. 7A, then the maximum unbalance also occurs when the exercise weight is in Exercise Cavity "#1 only." As in Example #8A, the base weight of medicine balls (i.e. before additional exercise weights are added) in this Example #8B are either 2.33 lb or 3.43 lb. As before, this weight medicine ball may be suitable for someone recovering from an injury or for a child, or anyone requiring a medicine ball with an initial weight of less than four (4) lb. In this example, 1 lb. exercise weights were added which may be more appropriate for someone requiring a medicine ball with an initial weight this low. Adding exercise weights with an even lower weight (e.g. 0.75 lb., 0.5 lb., etc.) would result in a further reduction in the maximum unbalance. Configurations of a variable weight medicine balls which do not use balance weights and which achieve a maximum unbalance to be five percent (5%) or less may be limited to only very low weights. Alternatively, other variables could also be changed (e.g. ball circumference) and the same analysis conducted to determine the maximum unbalance and a design a variable weight medicine ball meeting the desired unbalance.

Now consider Example #9, in which the maximum unbalance will be found if one wanted to design a variable weight medicine ball using balance weights and have an overall higher weight than in Examples 8A and 8B. In this example, the medicine ball may have an empty weight of 8 lb., a circumference of 45 cm and be able to add up to four-2 lb. exercise weights. Only two variables will be varied, the filling material density (0.93 lb./ft$^3$ and 2.17 lb./ft$^3$) and the location of the exercise cavities (exercise weight configurations shown in FIG. 6A and FIG. 7A. The total balance weight will be adjusted depending on the filling material density to reach an 8 lb. base weight. The same process will be followed as in Examples #6 and #7 to determine the maximum percent unbalance for which configuration of exercise weights that occurs in the medicine ball (i.e., either FIG. 6A or FIG. 7A). The following variables will be remain the same as in Examples #6 and #7:

CircumMedBall=45 (inches)

RadMedBall=7.16 (inches)

WtMedBall=dependent upon density of filling material (lb.)

WtShellFlex=1.0 (lb.)

FoamDensity=either 0.93 lb./ft$^3$ and 2.17 lb./ft$^3$, see table below

WtFillMatl=dependent upon density of filling material (lb.)

WtRecept=0.50, (lb.)

WtAllBalWt=dependent upon density of filling material (lb.)

NumBalWt=6

WtBalWt=dependent upon density of filling material (lb.)

With the choice of:

NumExWt=4

WtExWt=2.0 lb.

The table below shows the maximum percent unbalance (and exercise weight configuration for which the maximum unbalance occurs) for the parameters listed above.

Example #9

| | | MAXIMUM PERCENT UNBALANCED Six Balance Weights 2 lb Exercise Weights Exercise Weight Location | |
|---|---|---|---|
| | | FIG. 6 (3" radius) | FIG. 7 (Center) |
| FOAM DENSITY (1b/ft^3) | 0.93 | 9.9% @ 1, 2 (Total Wt = 8.00 lb) (Foam Wt = 0.83 lb) (Total Balance Wt = 5.67 lb) | 4.6% @ 1 only (Total Wt = 8.00 lb) (Foam Wt = 0.83 lb) (Total Balance Wt = 5.67 lb) |
| | 2.17 | 9.9% @ 1, 2 (Total Wt = 8.00 lb) (Foam Wt = 1.93 lb) (Total Balance Wt = 4.57 lb) | 4.6% @ 1 only (Total Wt = 8.00 lb) (Foam Wt = 1.93 lb) (Total Balance Wt = 4.57 lb) |

The results show the maximum unbalance varying from 9.9% (foam density of 0.93 lb./ft$^3$ 6 or 2.17 lb./ft$^3$ with exercise weights as shown in FIG. 6A) to 4.6% (foam density of 0.93 lb./ft$^3$ or 2.17 lb./ft$^3$ with exercise weights as shown in FIG. 7A). (Note that the same result of 9.9% maximum unbalance for a foam density of 2.17 lb./ft$^3$ and exercise weights as shown in FIG. 6A was obtained in Example #6). Medicine balls with this range of unbalance will exhibit almost none (4.6%) to mild (9.9%) unbalance, and therefore little to no wobble, when thrown and greatly reduce the chance of injury. As in previous examples, as the foam density increases the foam mass increases (because the volume of foam remains unchanged). But unlike Examples #8A and #8B, the increased foam density does NOT reduce the unbalance due to the addition of the exercise weight(s). This is because the total weight of the medicine ball determines the amount of unbalance. In this Example #9, the total weight of the variable weight medicine ball remains the same regardless of the foam density. This is because the total balance weight is adjusted to reach the desired empty weight of the medicine ball as the foam density varies. Since the center of gravity of the foam, balance weights, shell, and receptacle are all located at the geometric center of the medicine ball, their combined weight is used to determine the amount of unbalance when exercise weight(s) are added. If a less dense foam is used (e.g., 0.93 lb./ft$^3$ rather than 2.17 lb./ft$^3$), then the total balance weight will be increased (e.g. from 4.57 lb. to 5.67 lb. as in this Example #9) to reach the desired empty weight (e.g. 8 lb.) of the medicine ball. The choice of foam density can be made on a variety of factors including how it feels to the user when throwing and catching the ball. In one embodiment, polyurethane foam of density 2.0 lb./ft$^3$ or greater is used to minimize the total balance weights required to achieve a desired empty weight of the variable weight medicine ball.

As before, the results also show that as the exercise weights are added closer to the geometric center of gravity of the ball (e.g., as shown in FIG. 7A) the unbalance is less (4.6% compared to 9.9%) than when the exercise weights are located further from the geometric center of gravity of the ball (e.g., as shown in FIG. 6A). However, in this Example #9, the exercise weight cavity (e.g. "1 only" or "1 and 2") showing the maximum unbalance depends on the exercise weight configuration (either FIG. 6A or FIG. 7A). This means that when the exercise weight configuration is as shown in FIG. 6A, the 2 lb. exercise weights are in cavities "1 and 2" when the maximum unbalance of 9.9% occurs. But when the exercise weight configuration is as shown in FIG. 7A, the maximum unbalance of 4.6% occurs when a single 2 lb. exercise weight is in cavity "1 only". It is significant to note that the maximum unbalance is less with the exercise weight configuration shown in FIG. 7A than in FIG. 6A because the exercise weights are closer to the geometric center of the medicine ball. In many embodiments, 2 lb. exercise weights are a good match for this design because the maximum unbalance is less than the target maximum unbalance of 5% is achievable. One could choose to add heavier exercise weights, but heavier weights might result in an increase in the maximum unbalance.

As discussed previously, the moment of inertia for the medicine ball with different configuration of exercise weights can be calculated using the parallel axis theorem, which is known in the art of mechanical engineering. For example, the moment of inertias for the case in Example #9, for a foam density of 0.93 lb./ft$^3$, with Exercise Weights as shown in FIG. 6, (which resulted in a maximum unbalance of 9.9% with two-2 lb. exercise weights in cavities #1 and #2) can be calculated for the empty medicine ball as well as all configurations of exercise weights. The results of the calculations are shown in the table below:

Example #9

| Moment of Inertia | | | |
|---|---|---|---|
| | Base Weight WITH Six Balance Weights All "I" include Parallel Axis Theorem | | |
| | IZ (vertical) (lb * in^2) | IX (horizontal to Right) (lb * in^2) | IY (out of page towards you) (lb * in^2) |
| Fabric Shell & Closure (including zipper) | 33.7 | 33.7 | 33.7 |
| Foam Sphere | 17.0 | 17.0 | 17.0 |
| Balance Weights | 159.8 | 159.8 | 159.8 |
| TOTAL INITIAL I | 210.5 | 210.5 | 210.5 |
| Weight Tube Configuration | Total Moment of Inertia With Weight Tube(s) (lb * in^2) | | |
| 1 only | 228.6 | 238.7 | 221.2 |
| 2 only | 228.6 | 221.2 | 238.7 |
| 2, 4 | 246.7 | 231.8 | 266.9 |
| 1, 2 | 246.7 | 249.4 | 249.4 |
| 1, 3 | 246.7 | 266.9 | 231.8 |
| 1, 2, 4 | 264.8 | 260.1 | 277.6 |
| 1, 2, 3, 4 | 282.9 | 288.3 | 288.3 |

-continued

| Moment of Inertia | | | | |
|---|---|---|---|---|
| Weight Tube Configuration | % Change from Initial Total Moment of Inertia With Weight Tube(s) | | | Largest Difference in Moment of Inertia |
| 1 only | 8.6% | 13.4% | 5.1% | 8.3% |
| 2 only | 8.6% | 5.1% | 13.4% | 8.3% |
| 2, 4 | 17.2% | 10.1% | 26.8% | 16.7% |
| 1, 2 | 17.2% | 18.5% | 18.5% | 1.3% |
| 1, 3 | 17.2% | 26.8% | 10.1% | 16.7% |
| 1, 2, 4 | 25.8% | 23.6% | 31.9% | 8.3% |
| 1, 2, 3, 4 | 34.4% | 37.0% | 37.0% | 2.6% |

The results illustrate the moment of inertia about the three Cartesian axes X, Y, and Z for different conditions: initial moment of inertia of the empty ball with balance weights but before exercise weights are added and then the total moment of inertia with different configurations of exercise weights added to the medicine ball. The last set of results show the percent change in moment of inertia from the initial moment of inertia of the empty ball for each case of an added exercise weight. For example, the initial moment of inertia of the empty ball about the vertical Z axis is 210.5 lb./in$^2$. Then, when one 2 lb. exercise weight is placed in exercise weight configuration "1 only", the total moment of inertia of the ball about the vertical Z axis with the exercise weight added is now 228.6 lb./in$^2$. This means the moment of inertia has increased 8.6% about the vertical Z axis with the addition of the single exercise weight. The moment of inertia results give an indication of how the medicine ball will feel as exercise weights are added compared to the initial medicine ball. The primary goal is to minimize the unbalance created by the addition of exercise weights and uses the moment of inertia results as a secondary evaluation on the effectiveness of the choice of design variables (e.g., choice of foam density, exercise weight configuration, etc.).

Those skilled in the art can readily recognize that numerous variations and substitutions may be made in the disclosure, its use and its configuration to achieve substantially the same results as achieved by the embodiments described herein. Accordingly, there is no intention to limit the disclosure to the exemplary forms. Many variations, modifications and alternative constructions fall within the scope and spirit of the disclosure.

The invention claimed is:

1. A ball having an outer shell, an interior, and a radius, comprising:

an opening forming a portion of the outer shell that provides access to the interior, at least one exercise weight cavity in the interior configured to receive one or more exercise weights, a filling material disposed in the interior, between the at least one exercise weight cavity and the outer shell, and one or more balance weights that are different from the exercise weights, wherein the one or more balance weights are fixedly disposed within the filling material.

2. The ball of claim 1, wherein the center of gravity of all of the one or more balance weights combined is located substantially in the geometric center of the ball.

3. The ball of claim 1, wherein a percentage of weight unbalance of the ball is less than or equal to twenty percent as measured by a magnitude of unbalance of weight in all directions from a center of gravity of the ball divided by the radius of the ball.

4. The ball of claim 1, further comprising:

a balance weight support structure that holds the one or more balance weights in fixed positions within the filling material.

5. The ball of claim 1, wherein the one or more balance weights comprises six balance weights of substantially equal mass, and wherein:

the six balance weights comprise three pairs of balance weights, each pair being disposed along each one of three-dimensional coordinate axes of the ball, and each individual balance weight being disposed equidistantly from a center of the ball as its pair.

6. The ball of claim 1, wherein the percentage of weight unbalance is less than or equal to five percent.

7. The ball of claim 1, wherein the at least one exercise weight cavity comprises a plurality of separate weight cavities.

8. The ball of claim 1, further comprising:

at least one exercise weight receptacle disposed within the at least one exercise weight cavity.

9. The ball of claim 1, wherein the opening is substantially in the shape of a circle and forms a lid, the circle having a diameter less than the largest diameter of the ball.

10. The ball of claim 9, wherein the lid remains at least partially attached to the ball when a closure of the lid is fully opened.

11. The ball of claim 1, wherein the filling material is comprised of polyurethane foam.

12. The ball of claim 1, wherein the at least one exercise weight cavity comprises at least three exercise weight cavities, and the percentage of weight unbalance remains under twenty percent when any of:

the plurality of weight cavities remains empty, or exactly one exercise weight cavity holds an exercise weight, or more than one, but less than all of the exercise weight cavities holds exercise weights, or all of the exercise weight cavities hold exercise weights.

13. A system for varying the weight of a medicine ball with a minimum of weight unbalance, the system comprising:

a ball having an outer shell, an interior, and a radius, comprising:

an opening forming a portion of the outer shell that provides access to the interior, at least one exercise weight cavity in the interior configured to receive one or more exercise weights, a filling material disposed in the interior, between the at least one exercise weight cavity and the outer shell;

one or more balance weights fixedly disposed within the filling material; and a plurality of exercise weights configured to fit within the at least one exercise weight cavity.

14. The system of claim 13, wherein a percentage of weight unbalance of the ball is less than or equal to twenty percent as measured by a magnitude of unbalance of weight in all directions from a center of gravity of the ball divided by the radius of the ball.

15. The system of claim 13, wherein each of the plurality of exercise weights are substantially the same weight.

16. The system of claim 13, wherein each of the plurality of exercise weights are substantially the same shape.

17. The system of claim 13, wherein one or more of the plurality of exercise weights comprises a handle that is accessible by a user when the opening is opened.

18. The system of claim 13, further comprising:

one or more exercise weight receptacles configured to fit within the at least one exercise cavity and to receive an exercise weight.

19. The system of claim 18, wherein the one or more exercise weight receptacles comprises a roughly textured surface.

20. The system of claim 13, wherein the one or more exercise weight cavities comprises four cavities, and further comprising;

visual indicators to instruct a user of an order in which to insert one or more of the plurality of exercise weights.

21. A ball having an outer shell, an interior, a radius, and circumference, comprising:

at least one exercise weight cavity in the interior configured to receive one or more exercise weights, a filling material disposed in the interior, between the at least one exercise weight cavity and the outer shell, and one or more balance weights that are different from the exercise weights, wherein the one or more balance weights are fixedly disposed within the filling material, wherein the ball is separable into two substantially equal hemispheres by opening a closure along the circumference of the ball, and a portion of the at least one exercise weight cavity is located in each of the hemispheres.

22. The ball of claim 21, wherein a percentage of weight unbalance of the ball is less than or equal to twenty percent as measured by a magnitude of unbalance of weight in all directions from a center of gravity of the ball divided by the radius of the ball.

23. The ball of claim 21, further comprising:

a balance weight support structure that holds the one or more balance weights in fixed positions within the filling material.

24. The ball of claim 21, wherein the one or more balance weights comprises six balance weights of substantially equal mass, and wherein:

the six balance weights comprise three pairs of balance weights, each pair being disposed along each one of three-dimensional coordinate axes of the ball, and each individual balance weight being disposed equidistantly from a center of the ball as its pair.

25. The ball of claim 21, wherein the percentage of weight unbalance is less than or equal to five percent.

26. The ball of claim 21 wherein the at least one exercise weight cavity comprises a plurality of separate weight cavities.

27. The ball of claim 21, further comprising:

at least one exercise weight receptacle disposed within the at least one exercise weight cavity.

28. The ball of claim 21, wherein the filling material is comprised of polyurethane foam.

* * * * *